US009775413B1

(12) United States Patent
Ingimundarson et al.

(10) Patent No.: US 9,775,413 B1
(45) **Date of Patent: *Oct. 3, 2017**

(54) VERSATILE JEWELRY

(71) Applicants: Arni Thor Ingimundarson, San Diego, CA (US); Shireen Maria Thor, San Diego, CA (US)

(72) Inventors: Arni Thor Ingimundarson, San Diego, CA (US); Shireen Maria Thor, San Diego, CA (US)

(73) Assignee: AST DESIGN, LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,513

(22) Filed: Jun. 9, 2017

Related U.S. Application Data

(63) Continuation of application No. 15/462,116, filed on Mar. 17, 2017, which is a continuation-in-part of application No. 15/283,957, filed on Oct. 3, 2016, which is a continuation of application No. 15/076,055, filed on Mar. 21, 2016, now Pat. No. 9,526,304, which is a continuation of application No. 14/996,666, filed on Jan. 15, 2016, now Pat. No. 9,433,264, which is a continuation-in-part of (Continued)

(51) Int. Cl.
*A44C 5/00* (2006.01)
*A45D 8/34* (2006.01)

(52) U.S. Cl.
CPC ..... *A44C 5/003* (2013.01); *A44C 5/0023* (2013.01); *A44C 5/0092* (2013.01); *A45D 8/34* (2013.01); *A44D 2203/00* (2013.01)

(58) Field of Classification Search
CPC ... A44C 9/0084; A44C 9/0092; A44C 5/0007; A44C 5/003; A44C 5/0023; A44C 1/00; A44C 5/12; A44C 5/0053
USPC ..... 63/3, 15, 40, 43; 132/275, 276, 273, 132/333; 248/682; 24/3.2; D11/3, 4
See application file for complete search history.

(56) References Cited

U.S. PATENT DOCUMENTS 712,657 A 11/1902 Davis
971,519 A 10/1910 Brannen
(Continued)

OTHER PUBLICATIONS

"Beautiful Tiffany & Co. Sterling Cuff Bangle Bracelet 1997 1837 w/ Box," design copyrighted 1997, available as early as Dec. 1, 2015 at http://www.ebay.com/itm/Beautiful-Tiffany-Co-Sterling-Cuff-Bangle-Bracelet-1997-1837-W-Box-/252188042627?hash=item3ab7942583:g:QDsAAOSwo0JWN7GR, 7 pages.

(Continued)

*Primary Examiner* — Jack W Lavinder
(74) *Attorney, Agent, or Firm* — Workman Nydgegger

(57) ABSTRACT

A versatile jewelry includes a main body having a inner surface arranged to be worn against the wrist and an outer surface opposite the inner surface. First and second end portions define a clearance sized to receive the wrist when the main body is donned by the user. A circumferential groove is formed in the main body. A hair band is adapted to be selectively disposed within the groove and to span the clearance at a height above the inner surface. The main body is arranged to substantially hold the hair band in place when the hair band is disposed in the groove. The hair band has an elasticity and the main body has a rigidity arranged to resist the elasticity of the hair band and to distribute pressure from the hair band away from the wrist.

20 Claims, 18 Drawing Sheets

Related U.S. Application Data application No. 14/495,022, filed on Sep. 24, 2014, now Pat. No. 9,474,342.

(60) Provisional application No. 61/944,148, filed on Feb. 25, 2014, provisional application No. 61/881,720, filed on Sep. 24, 2013.

(56) References Cited

U.S. PATENT DOCUMENTS

| | | | |
|---|---|---|---|
| D77,688 | S | 2/1929 | Goldstein et al. |
| 1,935,504 | A | 11/1933 | Hargreaves |
| 1,938,206 | A | 12/1933 | Bigney |
| 2,168,490 | A | 8/1939 | Moss |
| 2,235,350 | A | 3/1941 | Anderson |
| D154,205 | S | 6/1949 | Kovacs et al. |
| 2,473,226 | A | 6/1949 | Sheldon |
| 2,653,402 | A | 9/1953 | Bonagura |
| D180,713 | S | 7/1957 | Hammond et al. |
| D186,822 | S | 12/1959 | Goodman et al. |
| 3,019,635 | A | 2/1962 | Kling |
| 3,542,041 | A | 11/1970 | Mercorella |
| 3,559,854 | A | 2/1971 | Loveland |
| 3,575,164 | A | 4/1971 | Heale |
| 3,610,488 | A | 10/1971 | Tracy |
| 3,680,751 | A | 8/1972 | Ten Brook |
| 3,842,849 | A | 10/1974 | Goodman |
| 4,502,298 | A | 3/1985 | Benton |
| 4,768,688 | A | 9/1988 | Harrigan |
| 5,044,385 | A | 9/1991 | Rhodes |
| D322,145 | S | 12/1991 | Coignard |
| 5,081,852 | A | 1/1992 | Cox |
| 5,186,186 | A | 2/1993 | Hamilton |
| D335,023 | S | 4/1993 | Hutcheson |
| 5,379,782 | A | 1/1995 | Tabb |
| D356,456 | S | 3/1995 | Henry |
| 5,456,270 | A | 10/1995 | Wong |
| 5,495,861 | A | 3/1996 | Liberman |
| 5,535,765 | A | 7/1996 | Takashima |
| D377,196 | S | 1/1997 | Sheppard, Jr. |
| 5,590,668 | A | 1/1997 | Macy |
| D389,423 | S | 1/1998 | Wein |
| 5,706,837 | A | 1/1998 | Iwata |
| D390,150 | S | 2/1998 | Wein |
| 5,727,574 | A | 3/1998 | Frye |
| 5,769,101 | A | 6/1998 | Iwata |
| 5,826,593 | A | 10/1998 | Haubrich |
| 5,829,457 | A | 11/1998 | Huang |
| 5,901,713 | A | 5/1999 | Mroczek |
| 5,927,297 | A | 7/1999 | Cooper |
| 6,000,408 | A | 12/1999 | Maturaporn |
| 6,003,521 | A | 12/1999 | Huang |
| 6,047,708 | A | 4/2000 | Panel et al. |
| 6,050,272 | A | 4/2000 | Droin |
| D428,670 | S | 7/2000 | Tsai |
| D429,657 | S | 8/2000 | Baghdassarian et al. |
| 6,105,837 | A | 8/2000 | Teed |
| 6,142,159 | A | 11/2000 | Lloyd |
| 6,260,383 | B1 | 7/2001 | Warren et al. |
| 6,267,120 | B1 | 7/2001 | Serignat |
| 6,276,368 | B1 | 8/2001 | Giamalva |
| 6,276,369 | B1 | 8/2001 | Rogers |
| 6,295,992 | B1 | 10/2001 | Sapp |
| D450,009 | S | 11/2001 | Molfese |
| 6,311,699 | B1 | 11/2001 | Horman |
| D458,867 | S | 6/2002 | Tschetter |
| 6,401,726 | B1 | 6/2002 | Sonstegard |
| 6,427,701 | B1 | 8/2002 | Roth |
| 6,439,242 | B1 | 8/2002 | Head et al. |
| 6,484,728 | B1 | 11/2002 | Chang |
| D468,190 | S | 1/2003 | Kennedy et al. |
| 6,513,535 | B1 | 2/2003 | Lane |
| 6,601,590 | B2 | 8/2003 | Neary |
| D482,982 | S | 12/2003 | McAnally |
| D499,043 | S | 11/2004 | Gavin |
| 6,880,364 | B1 | 4/2005 | Vidolin et al. |
| 6,928,734 | B1 | 8/2005 | West |
| 6,941,607 | B1 | 9/2005 | Berglass |
| 6,990,736 | B2 | 1/2006 | West |
| 7,004,179 | B1 | 2/2006 | Lunde |
| 7,017,589 | B1 | 3/2006 | Minnelli |
| 7,140,063 | B2 | 11/2006 | Osborne |
| 7,316,128 | B1 | 1/2008 | Dargusch |
| 7,433,275 | B2 | 10/2008 | Ellner et al. |
| 7,543,460 | B2 | 6/2009 | Cruise et al. |
| 7,581,548 | B2 | 9/2009 | Henricksen et al. |
| D603,287 | S | 11/2009 | Dzurek |
| 7,963,289 | B1 | 6/2011 | King |
| 7,996,922 | B2 | 8/2011 | Ross et al. |
| 7,997,100 | B2 | 8/2011 | Fossas |
| D646,600 | S | 10/2011 | Minkkinen et al. |
| 8,279,609 | B2 | 10/2012 | Rossi |
| D729,102 | S | 5/2015 | Becker et al. |
| 2002/0162564 | A1 | 11/2002 | Head et al. |
| 2004/0164034 | A1 | 8/2004 | Costanza |
| 2005/0034481 | A1 | 2/2005 | Saltz |
| 2005/0097921 | A1 | 5/2005 | Maruyama |
| 2005/0199659 | A1 | 9/2005 | Teed |
| 2006/0048542 | A1 | 3/2006 | Barry |
| 2006/0126444 | A1 | 6/2006 | Ellner et al. |
| 2006/0174650 | A1 | 8/2006 | Phillips et al. |
| 2007/0080077 | A1 | 4/2007 | Thormahlen |
| 2009/0145454 | A1 | 6/2009 | Saponaro et al. |
| 2009/0288673 | A1 | 11/2009 | Park |
| 2010/0078036 | A1 | 4/2010 | Naji |
| 2010/0180911 | A1 | 7/2010 | Kraft et al. |
| 2013/0133365 | A1 | 5/2013 | Zannella |
| 2014/0318180 | A1 | 10/2014 | Cabe |
| 2014/0326772 | A1 | 11/2014 | Pyper |
| 2015/0082830 | A1 | 3/2015 | Ingimundarson |

OTHER PUBLICATIONS

Peora Center Groove Two Tone Titanium Mens Cuff Bracelet, First available on Jul. 29, 2011, online. Visited on Oct. 12, 2016. Internet URL:<"https://www.amazon.com/dp/B005F58AOI/?tag=dadodu06-20">.

Scunci Girl No Damage Elastics, Snap Clips and Bracelet packs 17 Pieces, Amazon.com, First Available Apr. 14, 2014, Retrieved from Internet on Jan. 17, 2017.

Statement of Grant of Protection: GM Bulletin No. May 2008 , Global Design Database, International Registration No. DM/069854, http://www.wipo.int/designdb/hague/en/showData.jsp?SOURCE=HAGUE&KEY=DM069854, Mar. 18, 2008.

Women's Stainless Steel Cuff Bracelet with Matte Center, First available on Jun. 28, 2010, online. Visited on Sep. 26, 2016. Internet URL:< "https://www.amazon.com/Womens-Stainless-Steel-Bracelet-Center/dp/B002W70ZQI">.

"Elastic Holder Cuff", Ashley Bridget, First Available Oct. 12, 2016, Online. Visited on Mar. 31, 2017. https://www.ashleybridget.com/collections/trending-accessories/products/hair-elastic-bracelet-2?variant=32281965703.

"Tuck Silver Carr", Koli Collective, First Available Nov. 27, 2016. Online, Visited on Mar. 31, 2017. https://kolicollective.myshopify.com/products/everydaycarregold?variant=24055006405.

Request for Reexamination of U.S. Pat. No. 9,526,304, Jul. 21, 2017.

VERSATILE JEWELRY

FIELD OF ART

This disclosure relates to versatile jewelry having a combination of aesthetic and functional purposes, and to a versatile jewelry arranged to protect an arm or wrist from poor blood circulation, pressure marks, and a carrier to maintain hair accessories while providing aesthetically pleasing properties.

BACKGROUND

Many individuals wear a hair tie, such an elastic band, to keep their hair away from their face during certain activities. This style has also become fashionable where putting the hair into a ponytail presents a different look. The elastic band industry has grown tremendously with different styles, colors and sizes and elasticity being offered. Many individuals like to change their style throughout the day, wearing their hair down or putting it into a ponytail, depending on the look or functional activity they are performing. This poses an issue where an elastic band must keep the hair up, but it can easily get lose if being taken on and off constantly. This has caused many individuals to wear an elastic band around their wrist to ensure that they always have one around when needed.

A problem with wearing an elastic band is both the appearance, such as when an individual dresses up, and physical impact, such as forming a mark on the wrist due to the elastic band tightly fitting to a wrist and possible restriction in circulation of the arm. Solutions are offered to address the aesthetic part with many styles of elastic bands offered in different colors and with jewelry attached to the band but few if any solutions exist that properly address both issues at the same time; providing an aesthetically pleasing look and protecting the wrist from marks and poor circulation.

US patent application publication 2013/0133365, published May 30, 2013, describes a fully circumferential bracelet with a channel to wear a hair tie. Due to the circumferential design, the hair tie is located away from the wrist in a channel groove defined by the bracelet. Due to the inherent circumferential shape of the bracelet, it is difficult to remove the hair tie from the bracelet.

To solve this issue, the publication describes providing spaced indents along the circumference of the channel groove of the bracelet to allow fingers to grab the hair tie and remove it from the bracelet. These indents are not aesthetically pleasing and make the bracelet complicated, bulky and aesthetically limited. The indents prohibit or significantly reduce the ability to configure the bracelet with attractive features that make each bracelet unique in appearance because all bracelets made under the publication are recognized with the indents and must have significant bulk to accommodate such indents.

A significant trend is tracking activity with activity monitors. These activity monitors have been integrated into bracelets that also serve an aesthetic purpose. Certain companies promoting these type of bracelets include Nike with Fuelband, Fitbit and Jawbone. Technology of activity monitoring seems is similar, and companies differentiate on design and branding. A large segment of customers are young, active individuals. These users must remember to bring a hair tie to the gym and sometime wear them around their wrist so they don't forget them when they need them.

SUMMARY

Embodiments of the disclosure involve a versatile jewelry with an aesthetically pleasing look having an attachment point or retaining features for one or more hair accessories, such as a hair tie or elastic band, to maintain it in place and provide a distribution of pressure from the force created by the tension of the hair accessory, partially or completely around the wrist.

Embodiments of the versatile jewelry, such as a bracelet, preferably include an "open cuff" design, allowing for the bracelet to be low profile by sitting close to the wrist. The configuration makes it easy to place over the wrist by slipping it directly onto the wrist instead of passing over the hand; it is easy to remove the hair accessory by pulling at it where the bracelet is open. The open cuff design may include the bracelet being rigid or semi-rigid, and enable opening the bracelet to don over the wrist or the hand. The bracelet is sufficiently rigid cuff to keep the hair accessory from applying much pressure on the wrist while looking aesthetically pleasing on the wrist and offering versatility of appearances.

The open design may include a variety of shapes and is not limited to a circular profile. The profile may be oval, semi-oval, square or comprise other possible shapes. The contours of the bracelet are not limited to being uniform but rather they may be irregular and may be streamlined without a necessity of indents to remove the hair accessory.

It will be understood that the bracelet is not limited to the open cuff design, but may include many of the features described that enable a "closed cuff" design to easily remove a hair accessory.

According to an embodiment, the versatile jewelry includes a semi-rigid or rigid main body defining at least one retaining feature about the outer periphery. The main body is preferably formed from a metal or plastic, whereas the at least one hair accessory may be formed from an elastic material. The main body has a semi-circular profile and defines first and second opposing end portions with a clearance therebetween. The at least one retaining feature may be a groove formed into the outer surface of the main body and extending about its length.

At least one hair accessory, such as a hair tie or elastic band, is adapted to extend over the main body and was secured by the at least one retaining feature. The main body retains the at least one hair accessory therewith and spans the periphery of the main body and the clearance. The semi-rigid or rigid body resists the elasticity of the elastic band.

The at least one of the first and second opposing end portions may define a troughed portion enclosing an end of the at least one retaining feature, and the first and second opposing end portions may each define a troughed portion enclosing the at least one retaining feature. The groove may terminate short of the first and second end portions, and the at least one hair accessory is arranged to extend over the first and second end portions. The first and second end portions may suspend the at least one hair accessory at a height above the at least one retaining feature across the clearance.

The main body may define upper and lower portions having decorative features. The upper and lower portions may have a non-uniform profile or contour bordering the at least one retaining feature. Alternatively, the decorative feature may result in a highly streamlined profile comprising substantially thinned upper and lower portions and a thin groove forming the at least one retaining feature. At least one of the upper and lower portions may include attractive features secured thereon such as diamonds, colored beads, crystals, and other known types, and which do not interfere with the at least one retaining feature, and do not impede removal of the at least one hair accessory.

The first end portion may enclose the at least one retaining feature and the second end portion may open to the at least one retaining feature. The at least one retaining feature may be a groove, the first and second end portions open to groove.

In another embodiment, the main body defines first and second ledges protruding from the first and second end portions outside the upper and lower portions, respectively, and as the bottom periphery of the groove.

In another embodiment, the main body defines a sleeve protruding from upper and lower rims along the upper and lower circumferential edges, respectively. The upper and lower rims may radially outwardly protrude from the at least one retaining feature defined as a retaining surface formed by the main body.

The sleeve may extend over the at least one retaining feature and the at least one hair accessory. The sleeve may define upper and lower segments spaced apart by a gap. The gap may have contours to prohibit slippage of the hair accessory from the sleeve, such as non-linear segments. The non-linear segments may include a decorative feature, such as a squiggly line or other decorative yet functional design. The sleeve may include attractive features such as those described above and other indicia or attractive features such as a name, brand or other motif.

According to a method for wearing versatile jewelry, the method may include the steps of providing a semi-rigid or rigid main body about a wrist of a wearer wherein the main body defines at least one retaining feature about the circumference thereabout and first and second end portions spaced apart by a clearance; placing at least one hair accessory over the main body; securing the at least one hair accessory to the at least one retaining feature with the first and second end portions suspending the at least one hair accessory over the clearance; and wherein the main body prevents the hair accessory from exerting pressure over the wrist at which the main body extends.

The main body may also contain an activity or general health monitor of some sort. This allows the active user that wants to track activity with an activity monitor also to keep her elastic handy when required for active use. The user may place hair in a ponytail when going to the gym but may keep the hair straight during other daily activities. Having such a channel in an activity monitor allows them to make the hair tie a part of the design, serve an aesthetic purpose and to always be handy when needed. Activity monitor companies can also use this feature as a differentiating factor when comparing themselves to the competition by creating a version of their activity monitor bracelet.

The numerous advantages, features and functions of the embodiments of the versatile jewelry will become readily apparent and better understood in view of the following description and accompanying drawings. The following description is not intended to limit the versatile jewelry but instead merely provides exemplary embodiments for ease of understanding.

BRIEF DESCRIPTION OF THE DRAWINGS

These and other features, aspects, and advantages of the present invention will become better understood regarding the following description, appended claims, and accompanying drawings.

top view showing another embodiment of a versatile jewelry.

Figure 18A:
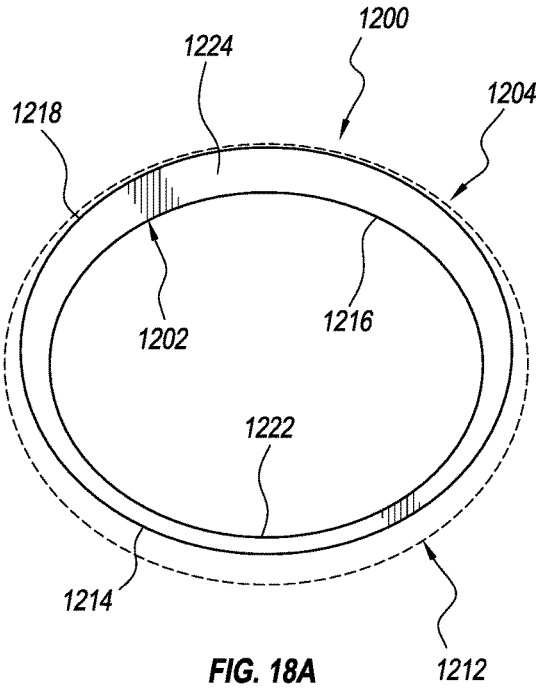

FIG. 18A is a side view showing another embodiment of a versatile jewelry.

Figure 18B:
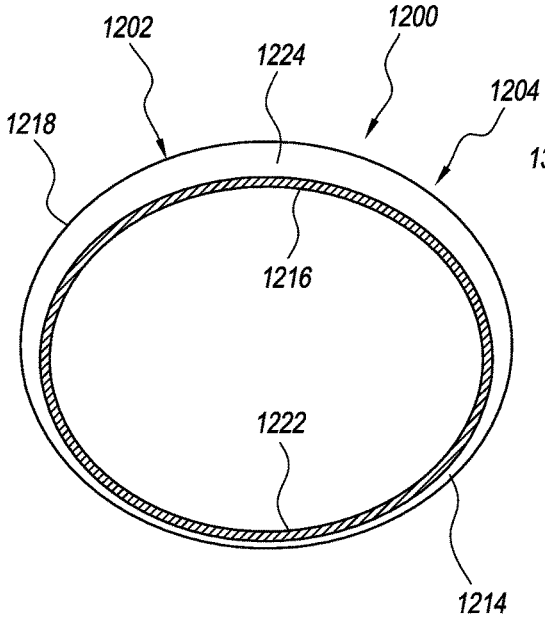

FIG. 18B is a cross section view of the versatile jewelry in FIG. 18A.

Figure 19A:
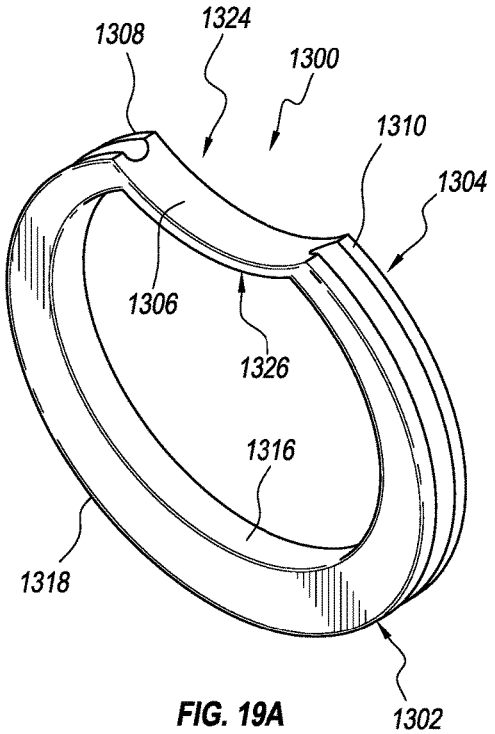

FIG. 19A is a perspective view showing another embodiment of a versatile jewelry.

Figure 19B:
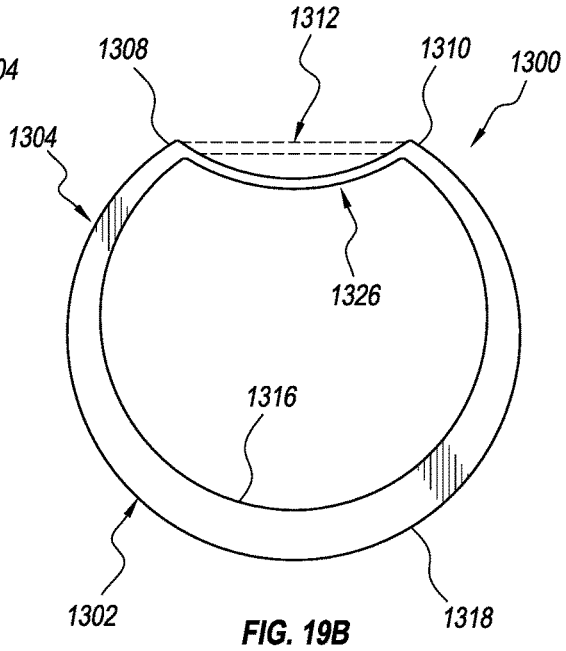

FIG. 19B is a side view of the versatile jewelry in FIG. 19A.

Figure 20:
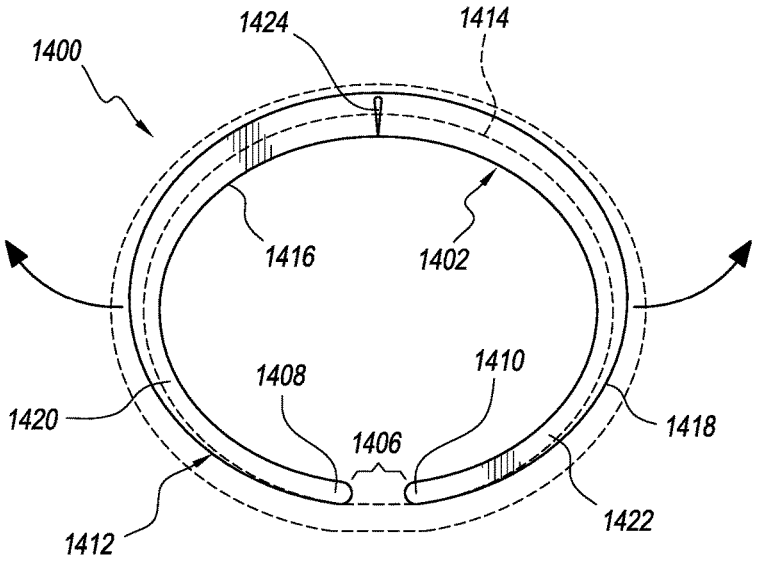

FIG. 20 is a side view showing another embodiment of a versatile jewelry.

Figure 21A:
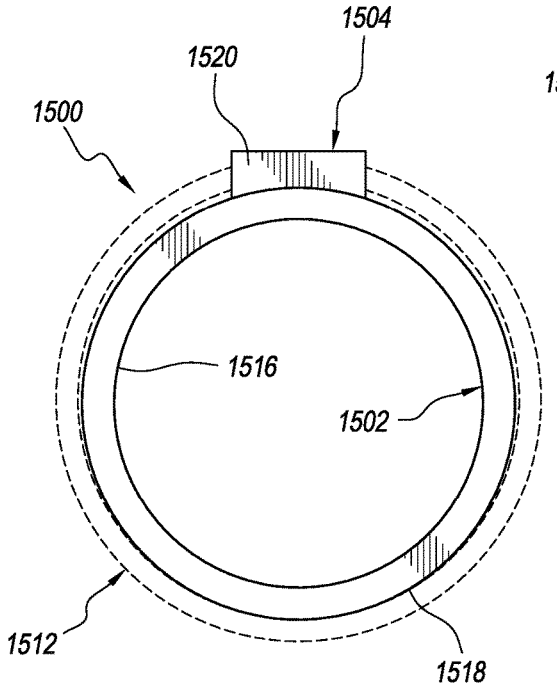

FIG. 21A is a side view showing another embodiment of a versatile jewelry.

Figure 21B:
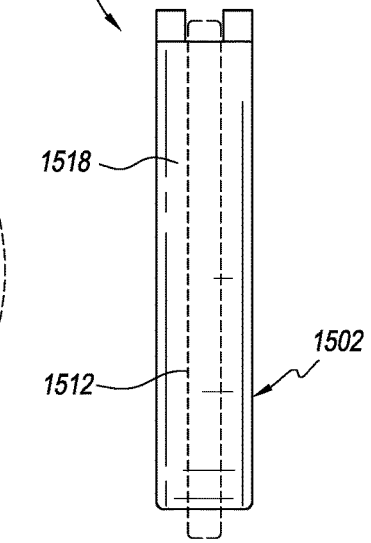

FIG. 21B is a front view of the versatile jewelry in FIG. 21A.

Figure 21C:
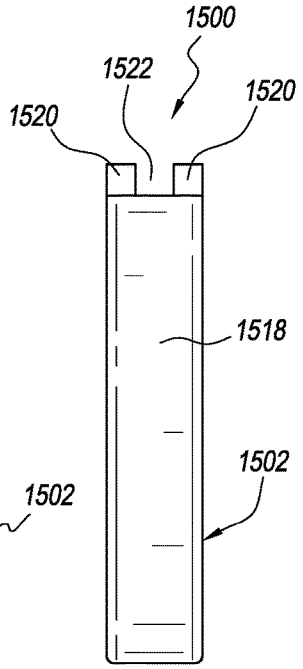

FIG. 21C is another front view of the versatile jewelry in FIG. 21A with the hair accessory removed for ease of reference.

Figure 22A:
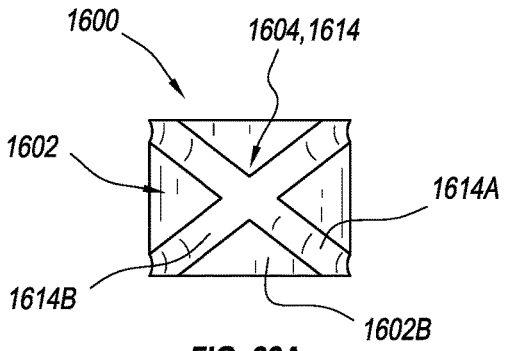

FIG. 22A is a top view showing another embodiment of a versatile jewelry.

Figure 22B:
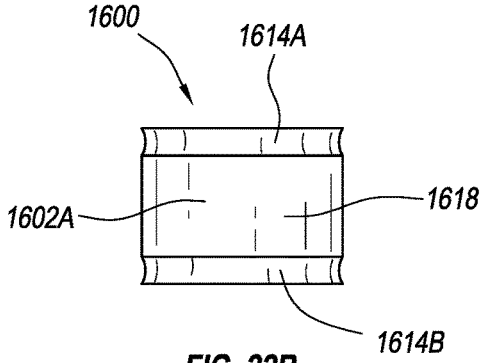

FIG. 22B is a bottom view of the versatile jewelry in FIG. 22A.

Figure 22C:
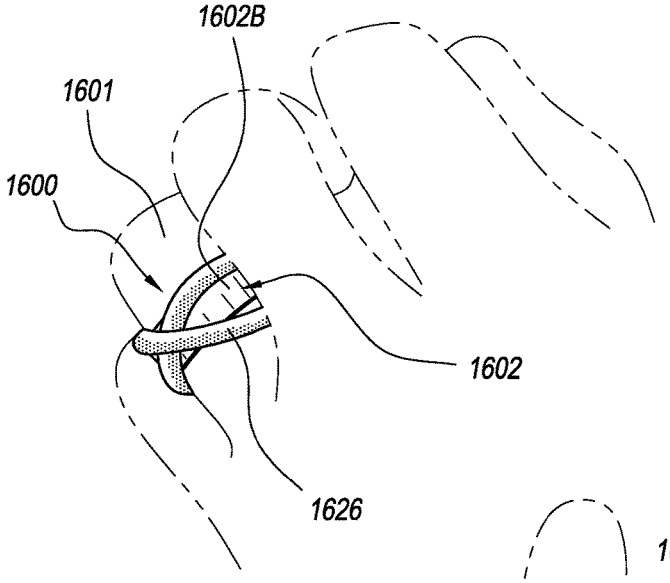

FIG. 22C is a top perspective view of the versatile jewelry in FIG. 22A on a finger.

Figure 22D:
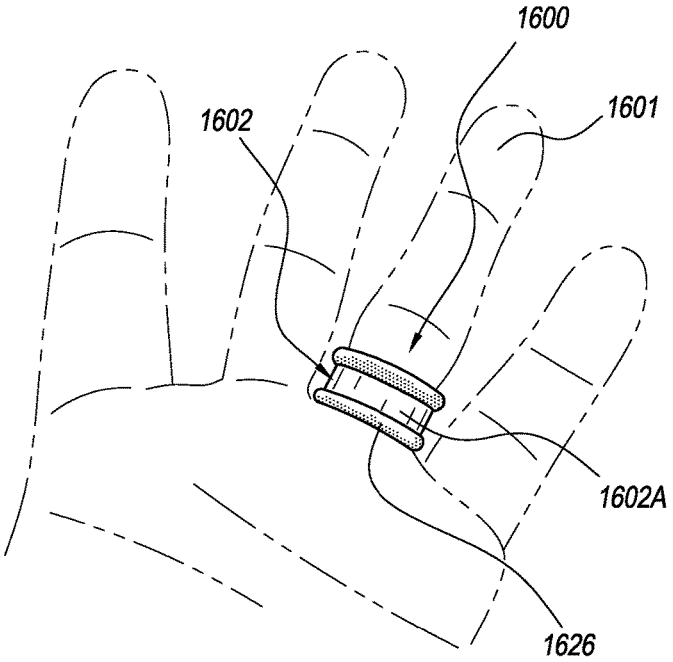

FIG. 22D is a bottom view of the versatile jewelry in FIG. 22A on a finger.

Figure 23:
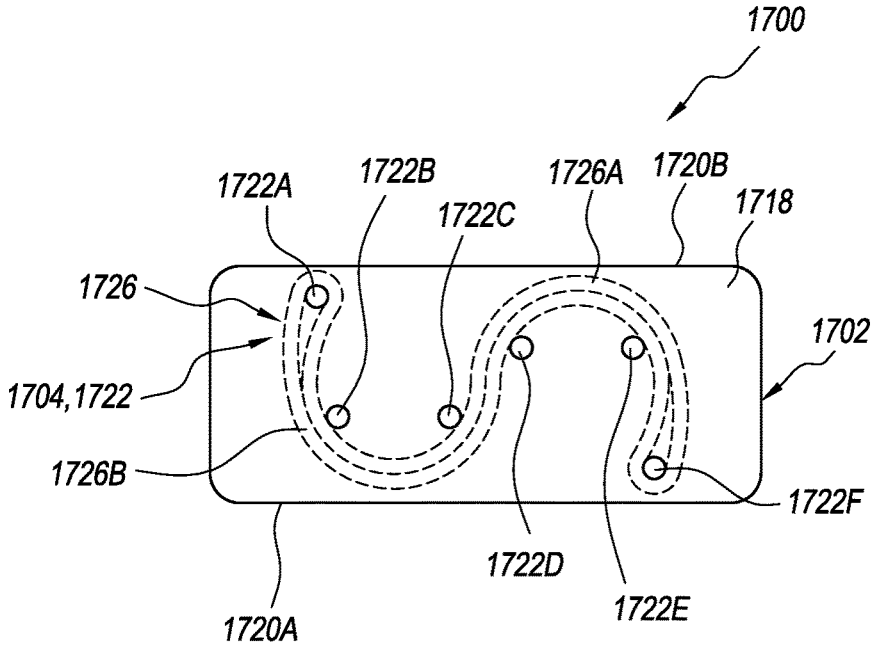

FIG. 23 is a top view showing another embodiment of a versatile jewelry.

Figure 24:
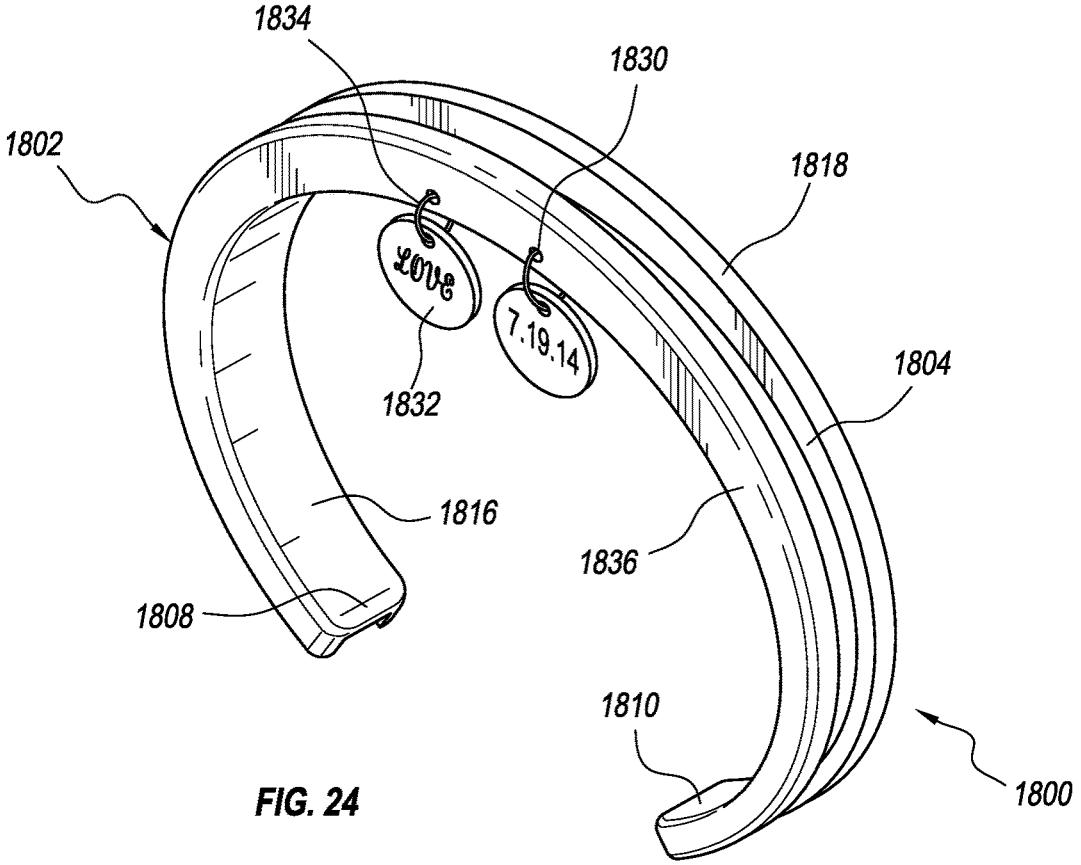

FIG. 24 is a perspective view showing another embodiment of a versatile jewelry.

Figure 25:
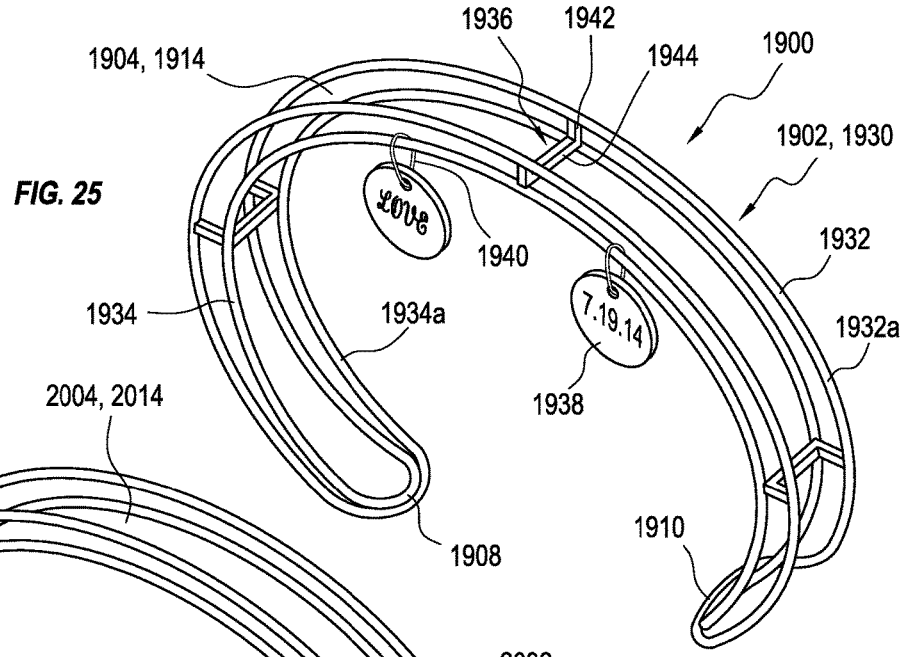

FIG. 25 is a perspective view showing another embodiment of a versatile jewelry.

Figure 26:
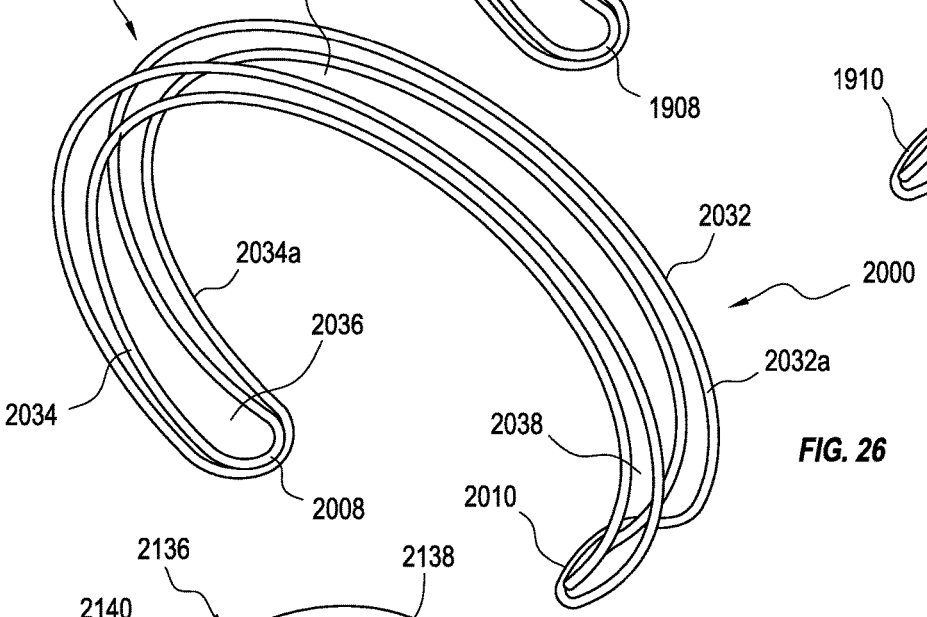

FIG. 26 is a perspective view showing another embodiment of a versatile jewelry.

Figure 27:
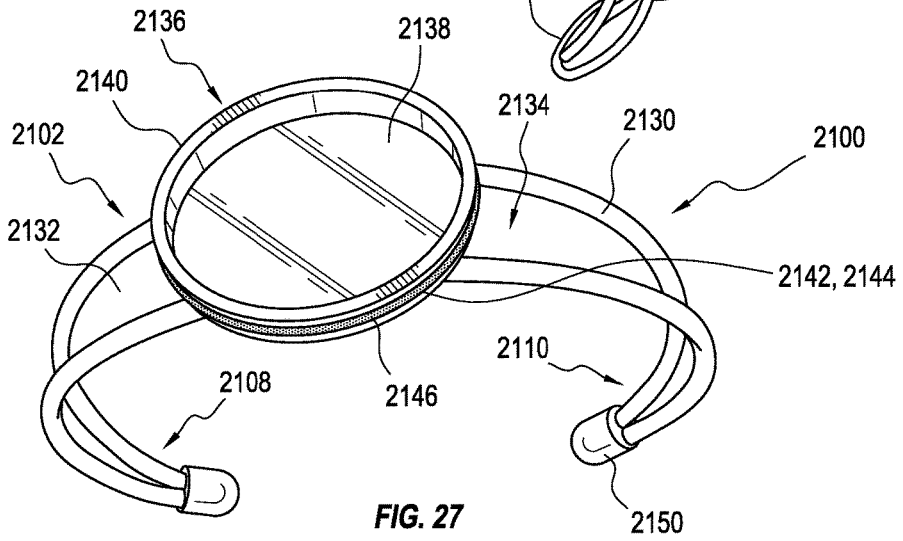

FIG. 27 is a perspective view showing another embodiment of a versatile jewelry.

Figure 28A:
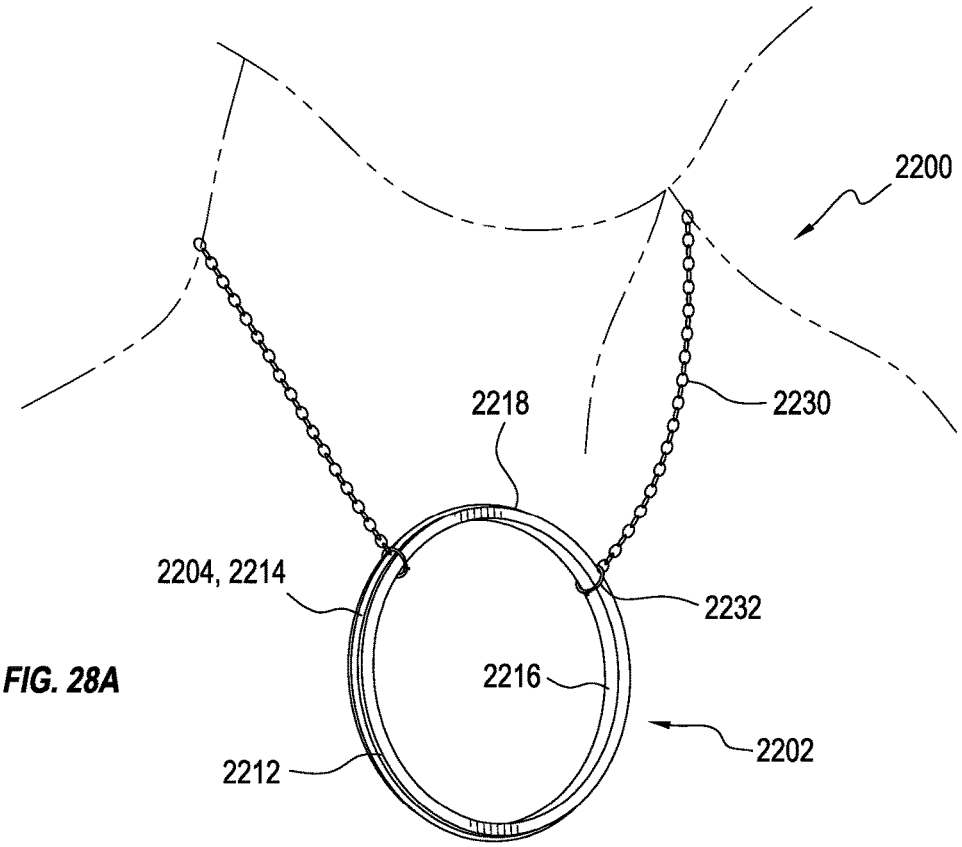

FIG. 28A is a perspective view showing another embodiment of a versatile jewelry.

Figure 28B:
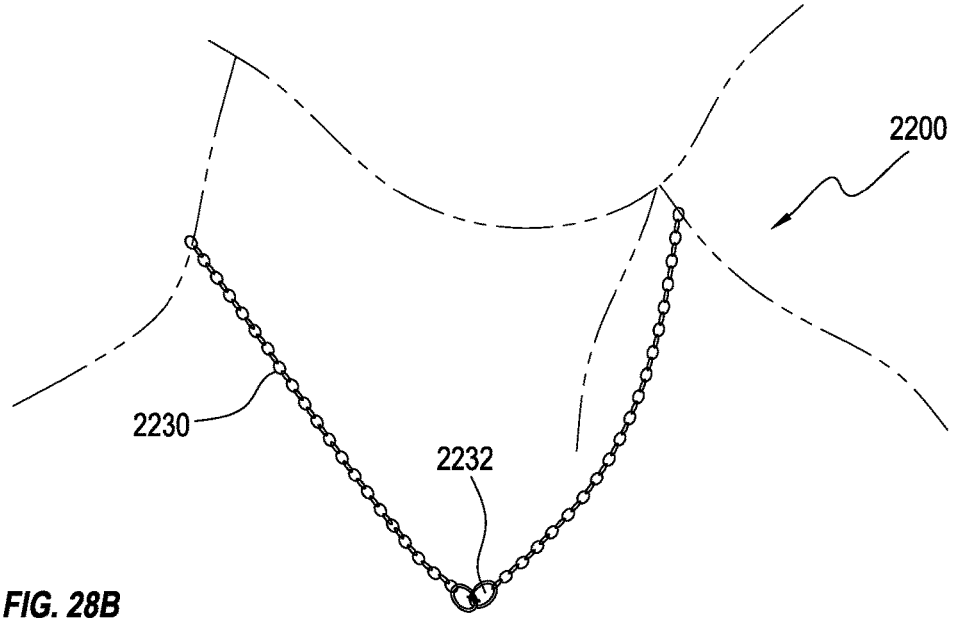

FIG. 28B is another perspective view showing the versatile jewelry of FIG. 28A.

In the figures, similar elements are provided with similar reference numbers. The drawing figures are not drawn to scale, or proportion, but instead are drawn to provide a better understanding of the components, and are not intended to be limiting in scope, but provide exemplary illustrations.

DETAILED DESCRIPTION OF VARIOUS EMBODIMENTS

Figure 1:
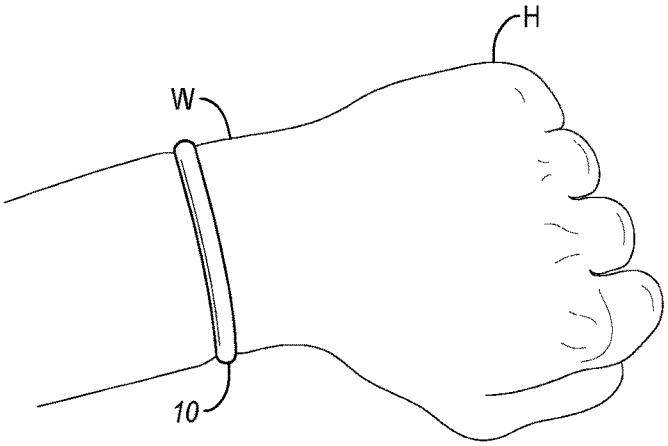
FIG. 1 (Prior Art)
FIG. 1 is a perspective view showing a prior art elastic band commonly worn around the wrist.

FIG. 1 shows a hair accessory or an elastic band 10 commonly worn by individuals that keep their hair flowing or in a ponytail through different times of the day. Keeping the elastic band on the wrist W by slipping it over the hand H ensures that it does not get lost and may be used by some as decoration.

Figure 2:
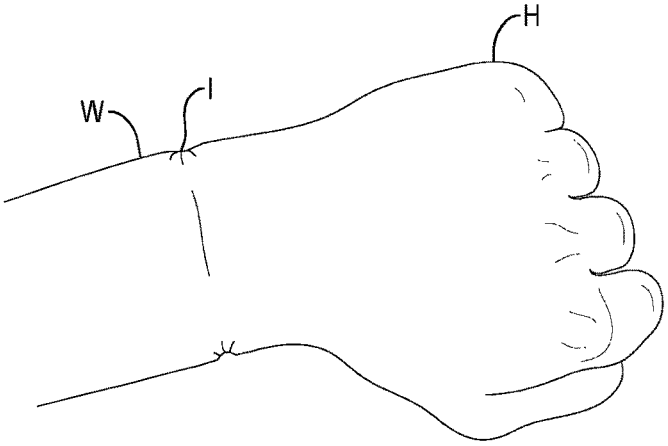
FIG. 2 is a perspective view showing a mark created from elastic band of FIG. 1 after minimal use.

An issue with wearing such an elastic band is shown in FIG. 2. The marks or indentation I left on the wrist are due to pressure exerted on the wrist W by the tension in the elastic band. The pressure leaves a mark, thereby creating discomfort and restricting circulation to the wrist W. There are times when one would not feel comfortable wearing just an elastic band on an arm, such as when wearing business attire or at an evening event where elegant clothing is essential. These individuals therefore must decide beforehand whether to keep their hair down or in a ponytail or else having to keep the band hidden in a pocket or a purse.

FIGS. 3A-7 show an exemplary embodiment 100 of the versatile jewelry. A main body 102 or bracelet partially wraps around the wrist W, and has a substantially smooth inner surface 128 arranged to be worn against a wrist. Material used in this bracelet can be any that holds its shape and distributes the pressure away from the wrist. Materials used can be silver, gold, steel, plastic, rubber, leather or any other material deemed usable to serve this purpose. The bracelet may be bent to shape to tightly conform to the user's wrist.

The bracelet 100 preferably includes an "open cuff" design, allowing for the bracelet to be low profile by sitting close to the wrist. The configuration makes it easy to place over the wrist by slipping it directly onto the wrist instead of passing it over the hand, and to remove the hair accessory by pulling at it where the bracelet in open. The open cuff design may include the bracelet being rigid or semi-rigid, and enabling opening the bracelet to don over the wrist or the hand. The bracelet is sufficiently rigid to keep the hair accessory from applying too much pressure on the wrist while looking aesthetically pleasing on the wrist and offering a variety of appearances.

The bracelet may be opened and due to the material of the bracelet being resilient, the bracelet returns to its original shape once it is released over the wrist. Alternatively, the bracelet may be elastic so that it is opened and then contracts over the wrist, such that the bracelet has a certain width to minimize concentration of pressure over the wrist.

Figure 11:
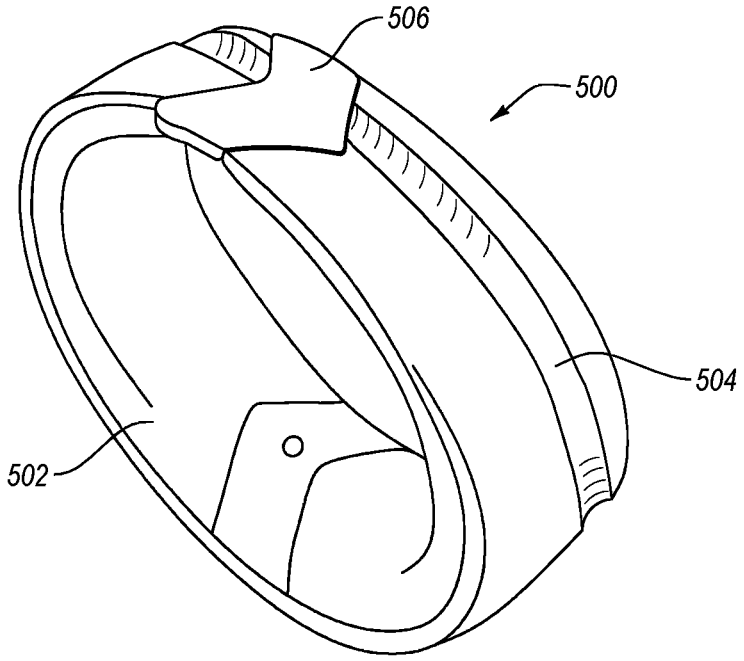
FIG. 11 is a perspective view showing another embodiment of a versatile jewelry having different colors.
Figure 12:
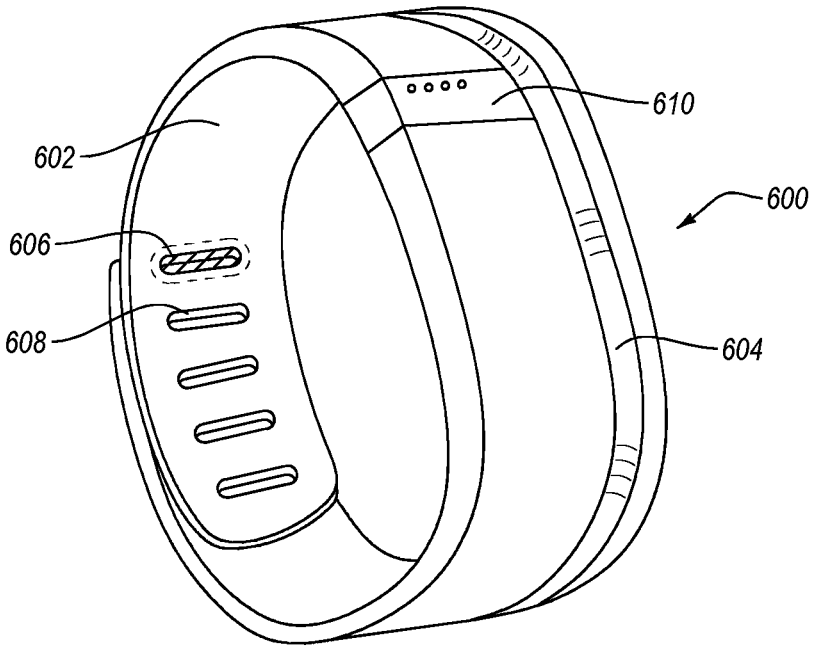
FIG. 12 is a perspective view showing another embodiment of a versatile jewelry.

The open cuff includes a clearance or opening 106 of the bracelet 100 allowing for the bracelet to be easily donned while ensuring that it stays well on the arm during any activity. The bracelet 100 can be circular but would then require a locking system that can allow access or to have the bracelet donned by putting the hand through the bracelet, as depicted in FIGS. 11 and 12. The retaining feature 112 may be in the form of a groove or channel 112 resembling the shape of the hair accessory, ensuring that the hair accessory stays within the confinement of the contour built into the bracelet 100. This method is not the only way the bracelet could be kept in place properly. Alternative methods such as: one or several hooks on bracelet; overlay or any built in shape that keeps the elastic in place; magnets inserted into bracelet and attached to elastic band; one or more ridges along the bracelet to ensure that one or more of the elastic bands do not move in place.

There may be a width of the bracelet formed between the upper and lower portions 114, 116 to ensure that the hair accessory does not slip from the bracelet 100 and therefore proper distribution of pressure from the hair accessory is ensured. If multiple hair accessories are worn, this can be solved by more than one groove or channel, or a wider channel to hold more than one hair accessory in the embodiments of 9A-9C.

From the exemplary examples, the versatile jewelry other than its ornamental design is to reduce the pressure applied by the elastic band on the wrist. The main body in a bracelet can completely lift the elastic band off the wrist or allow it to only apply a minimal amount of pressure in certain areas where the bracelet does not cover the arm.

According to the embodiment of FIGS. 3A-7, the versatile jewelry includes the semi-rigid or rigid main body 102 defining at least one retaining feature 112 defined about the outer periphery thereof between the first or upper and the second or lower portions 114, 116. The at least one hair accessory is preferably formed from an elastic material 104 but is not limited to elastic material and may comprise a tie or other element looped or secured to the main body 102. The main body has a semi-circular profile and defines first and second opposing end portions 108, 110 with a clearance 106 therebetween to form the open cuff design. The at least one retaining feature 112 may be a groove formed into the outer surface of the main body and extending about its length or circumference.

Figure 3A:
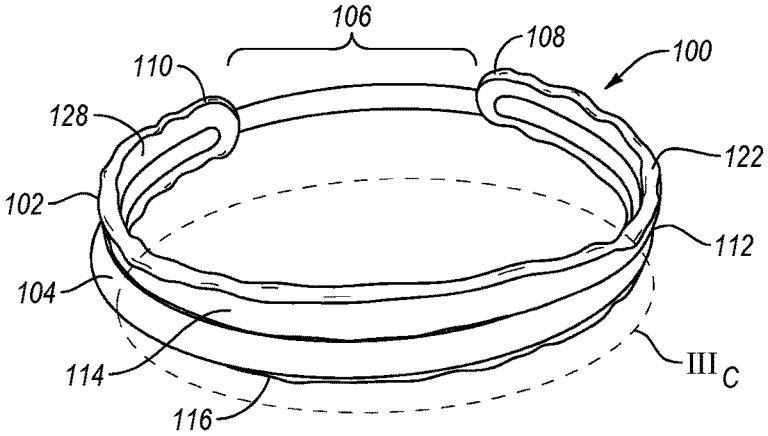
FIG. 3A is a front perspective view showing an embodiment of a versatile jewelry.
Figure 3B:
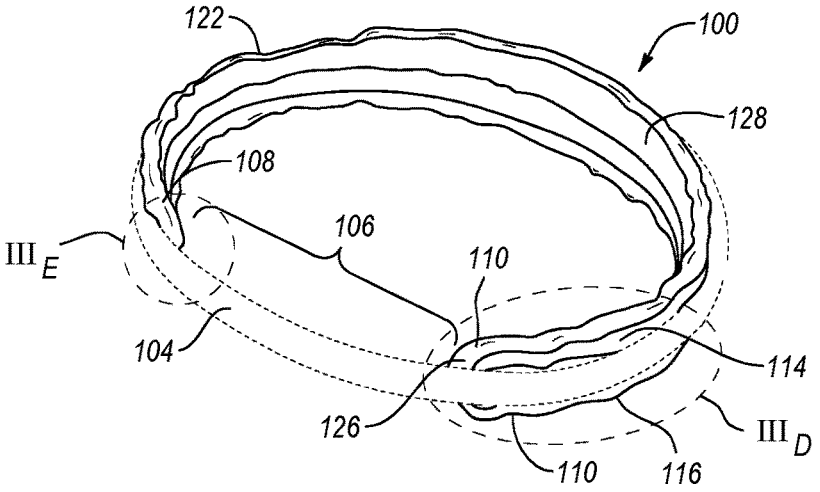
FIG. 3B is a rear perspective view of the embodiment of FIG. 3A.
Figure 3C:
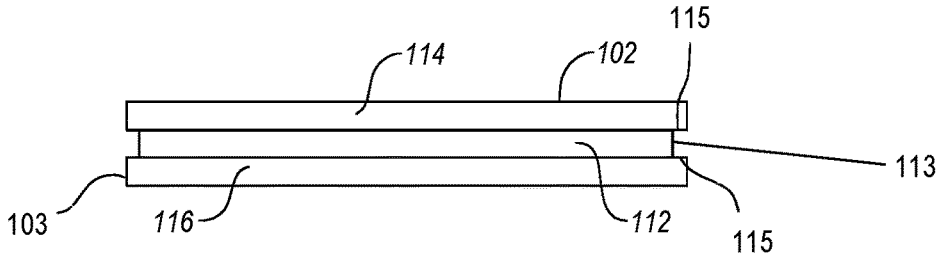
FIG. 3C is a front sectional view taken from the embodiment of FIG. 3A.

The groove 112 has a rectangular configuration as best seen in FIG. 3C including a bottom portion 113 and a pair of sidewalls 115 oriented substantially perpendicular to the bottom portion 113. The sidewalls 115 are substantially parallel to one another and extend between the bottom portion 113 and the outer surface 103 of the main body 102.

At least one hair accessory 104, such as a hair tie or elastic band, is adapted to extend over the main body 102 and arranged to be secured by the at least one retaining feature 112. The main body 102 retains the at least one hair accessory 104 therewith and spans the periphery of the main body 102 and the clearance 106. The semi-rigid or rigid body 102 resists the elasticity of the hair accessory 104.

Figure 3D:
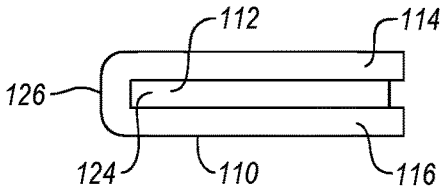
FIG. 3D is a top sectional view taken from FIG. 3B.
Figure 3E:
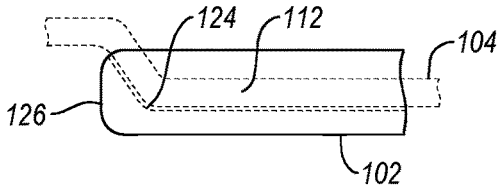
FIG. 3E is a side sectional view taken from FIG. 3B.
Figure 4:
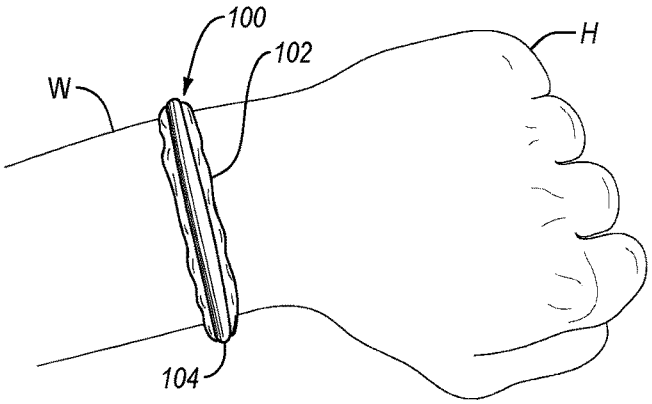
FIG. 4 is a top perspective view of the embodiment of FIG. 3A of a versatile jewelry protecting the skin from the compression of a hair accessory and distributing the pressure while enhancing the aesthetic appearance of the wrist.

As depicted in FIGS. 3D and 3E, at least one of the first and second opposing end portions 108, 110 defines a troughed portion 124, which encloses an end of the at least one retaining feature 112. The first and second opposing end portions 108, 110 may each define the troughed portion 124 enclosing the at least one retaining feature 112. The groove may terminate short of the first and second end portions 108, 110, and the at least one hair accessory 104 is arranged to extend over an end 126 of first and second end portions 108, 110. The first and second end portions 108, 110 may suspend the at least one hair accessory 104 at a height above the at least one retaining feature 112 across the clearance 106.

The main body 102 may define upper and lower portions 114, 116 having decorative features. The upper and lower portions may have a non-uniform profile or contour 122 bordering at least one retaining feature 112. Alternatively, the decorative feature may result in a highly streamlined profile comprising substantially thinned upper and lower portions and a narrow groove forming the at least one retaining feature. At least one of the upper and lower portions may include attractive features secured thereon such as diamonds, colored beads, crystals, and other known types, and which do not interfere with the at least one retaining feature 112 and do not impede removal of the at least one hair accessory 104.

Figure 5:
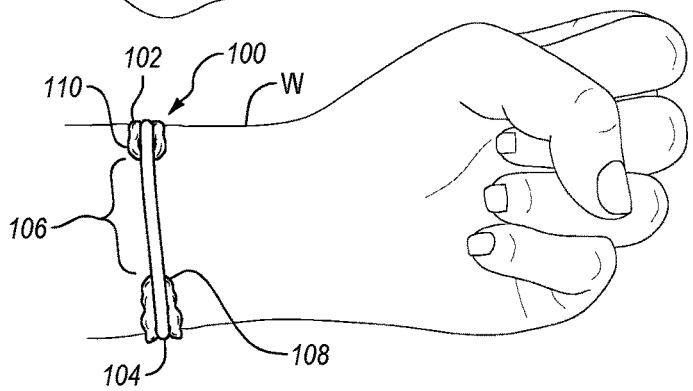
FIG. 5 is a rear perspective view of the embodiment of FIG. 3A on a wrist showing a clearance defined by a main body of the versatile jewelry.
Figure 7:
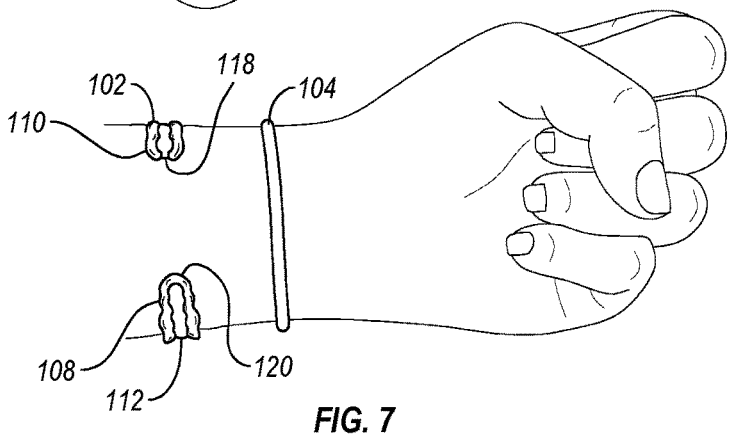
FIG. 7 is a schematic view of FIG. 6 showing a next step of removal of a hair accessory from the main body.

FIGS. 5 and 7 illustrate the first end portion 108 enclosing the at least one retaining feature in the form of a groove 112, and the second end portion 110 may open to the groove and direct the hair accessory 104 to the first end portion 108. The end portion 110 may have ends tapering toward the groove 112 to better retain the hair accessory relative to the main body 102.

Figure 6:
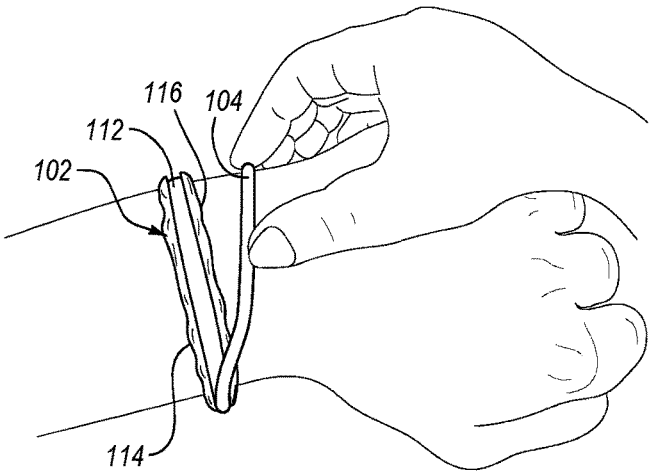
FIG. 6. is a schematic view of FIG. 4 showing a first step of removal of a hair accessory.

FIGS. 5-7 show how the hair accessory 104 can easily move off the main body 102 by intentional action of the user. A method for removing the hair accessory 104 involves pulling the hair accessory 104 from the clearance and disengaging the hair accessory 104 from the groove 112 to pull the hair accessory 104 away from the main body 102. The hair accessory 104 may be eventually pulled over the hand to use for the user's hair.

Figure 8A:
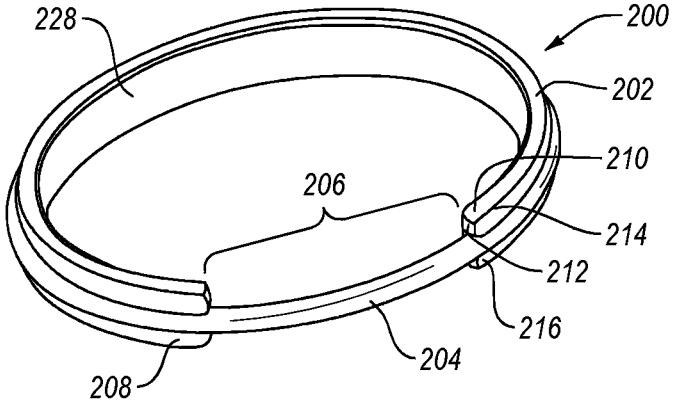
FIG. 8A is a front perspective view showing an embodiment of a versatile jewelry.
Figure 8B:
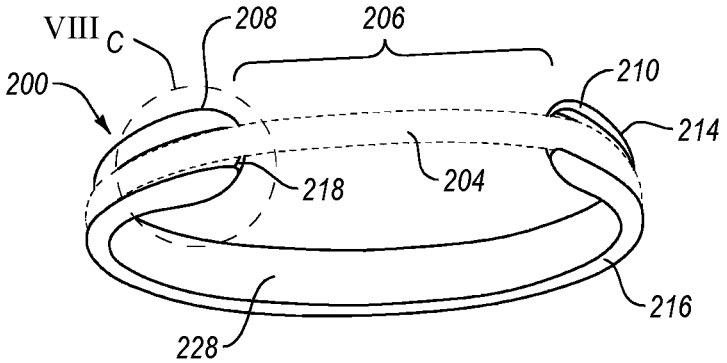
FIG. 8B is a rear perspective view of the embodiment of FIG. 8A.
Figure 8C:
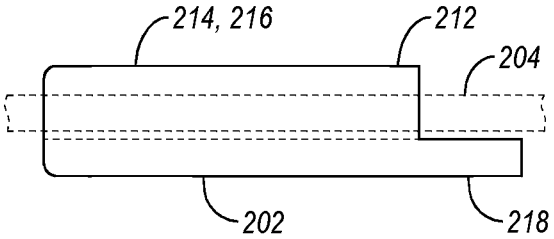
FIG. 8C is a side sectional view taken from FIG. 8B.

FIGS. 8A-8C disclose another embodiment of versatile jewelry 200 having a main body 202 and a hair accessory 204 in an elastic band. The main body 202 defines an inner surface 228 arranged to be worn against a wrist. A clearance 206 is defined between first and second end portions 208, 210, and at least one retaining feature 212 in the form of a groove opens at the end portions 208, 210. First or upper and second or lower portions 214, 216 subtend the groove 212.

FIG. 8C particularly shows how the end portions 208, 210 may include a ledge 218 protruding from the end portions 208, 210 to ease transition of the hair accessory 204 across the clearance 206.

Figure 9A:
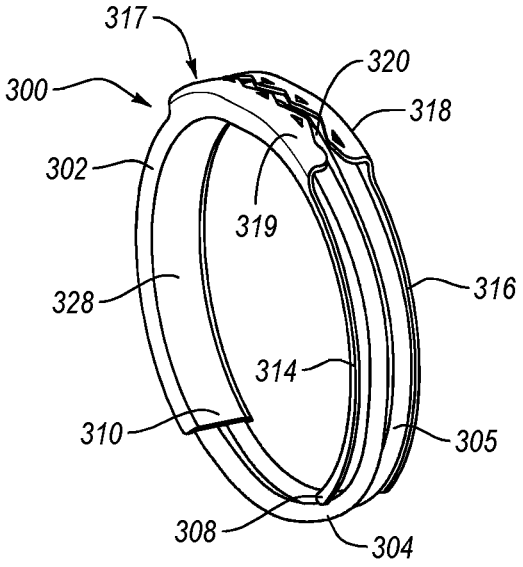
FIG. 9A is a front perspective view showing an embodiment of a versatile jewelry.
Figure 9B:
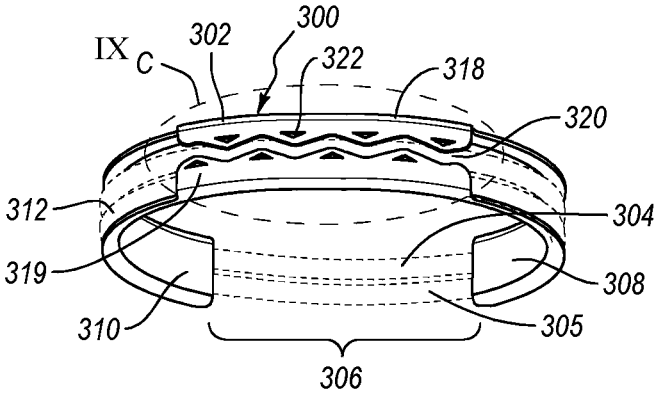
FIG. 9B is a rear perspective view of the embodiment of FIG. 9A.
Figure 9C:
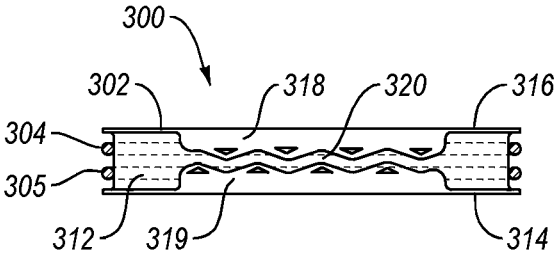
FIG. 9C is a front sectional view taken from FIG. 9B.

FIGS. 9A-9C disclose another embodiment of the versatile jewelry 300 having a main body 302 and a hair accessory 304 in the form of first and second elastic band 304, 305 within the at least one retaining feature 312. The main body 302 defines an inner surface 328 arranged to be worn against a wrist. A clearance 306 is defined between first and second end portions 308, 310, and at least one retaining feature 312. First or upper and second or lower portions 314, 316 subtend the groove 312, which is substantially widened over the previous embodiments to permit a single or multiple hair accessories 304.

In this embodiment, a sleeve 317 formed by first and second protruding portions 318, 319 is defined as radially extending outwardly from the main body 302 and over the groove 312. A gap or opening 320 is defined between the first and second protruding portions 318, 319. The gap 320 is configured and dimensioned to enable a user to place a hair accessory to slip therethrough and may be sized so the hair accessory must be thinned or lengthened to pass through the gap 320.

The gap 320 may form a non-linear shape according to how and where the first and second protruding portions 318, 319 face one another. The non-linear shape may prevent a hair accessory from sliding or slipping past the gap, and may be arranged in a decorative pattern. The protruding portions 318, 319 may include decorative features 322 such as designs or lettering (as in one's name, a company name or quote). The decorative features may be customized and vary from bracelet to bracelet.

Figure 10:
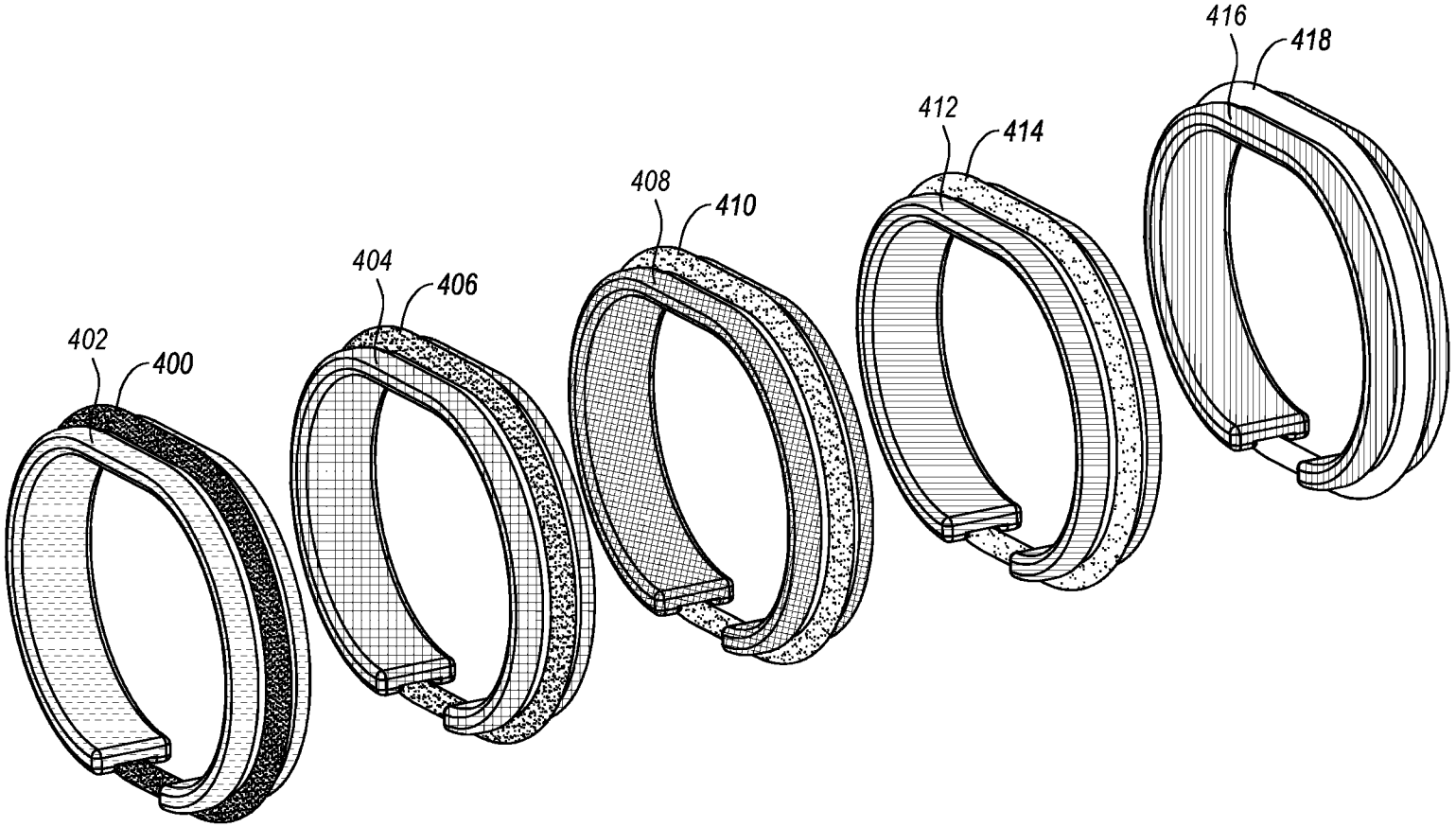
FIG. 10 is a perspective view showing a set of versatile jewelry.

FIG. 10 depicts a plurality of plastic main bodies 400, 404, 408, 412, 416 and 414, which may be coordinated with colors of different hair accessories 402, 406, 410, 414, 418. These main bodies may be constructed from a resilient plastic permitting expansion of the main body to be inserted onto a wrist and reversion to a predetermined shape once installed on a wrist in a relaxed configuration. Alternatively, the main body may be tensioned on a wrist should the wrist opening sized smaller than the wrist upon which it is worn. It may also be resilient to accommodate the hair accessories in the form of a band, which may compress the main body.

FIG. 11 shows an embodiment of a versatile jewelry 500 in which the main body 502 has a circumferential profile and a retaining feature 504 is formed by the main body 502. A clasp 506 is provided for opening the main body 502 and the retaining feature 504 is arranged to extend underneath the clasp 506 and can accommodate a hair accessory as described. The main body 502 may bear many the features described in connection with the preceding embodiments.

FIG. 12 describes another versatile jewelry 600 including a main body 602 and a retaining feature 604 formed by the main body 602. The main body 602 includes a sizing device with various slots 608 and tabs 606 adapted to vary and lock the size of the main body 602 on a user's wrist. The main body 602 may include a display 610 such as a clock, notification, etc.

Any of the preceding embodiments may be incorporated into a standard activity monitor bracelet such as Nike Fuelband, Jawbone Up and Fitbit Force or Flex.

Figure 13A:
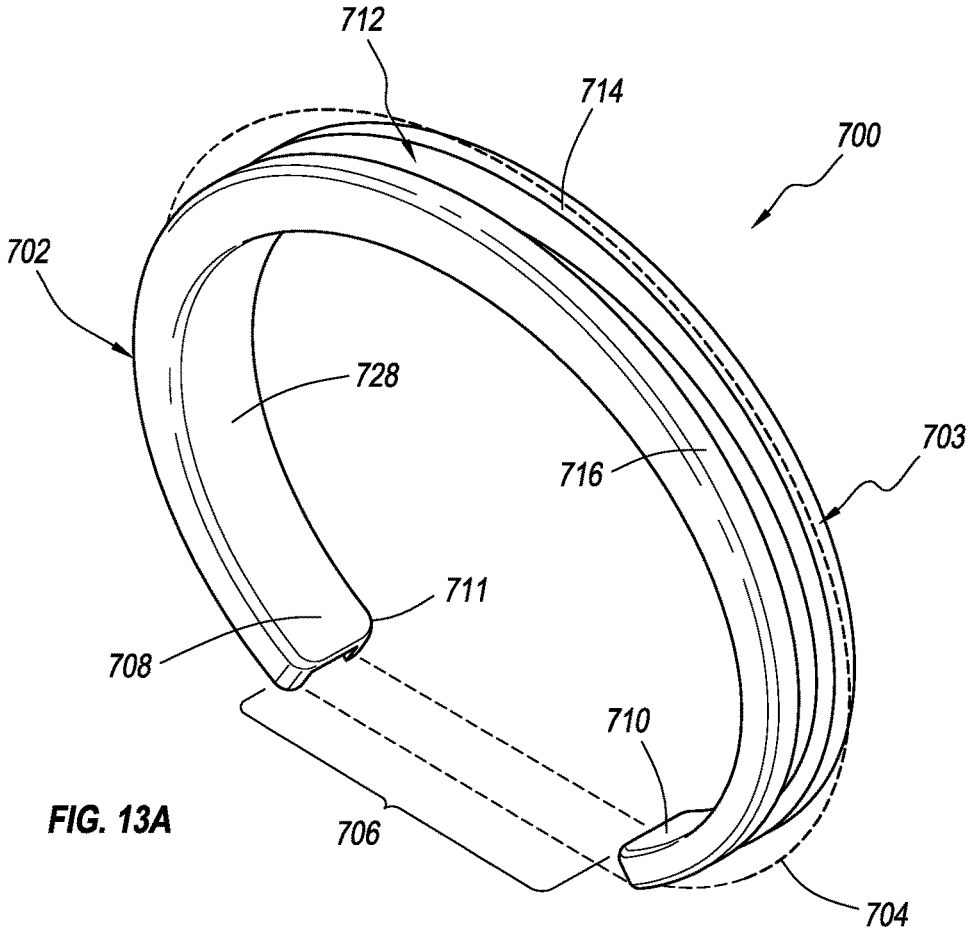
FIG. 13A is a perspective view showing another embodiment of a versatile jewelry.

FIGS. 13A-13E describe another versatile jewelry 700 comprising a bracelet 700. It will be appreciated that the bracelet 700 can include any of the features described above. As seen in FIG. 13A, the bracelet 700 includes a semi-rigid or rigid main body 702 and at least one retaining feature 704 defined about the outer periphery thereof between first or upper and the second or lower portions 714, 716. The main body 702 can define first and second opposing end portions 708, 710 with a clearance 706 therebetween to form an open cuff design. The clearance 706 allows for the bracelet 700 to be easily donned while ensuring that it stays well on the arm during various activities. The first and second opposing end portions 708, 710 may each include a radius 711, helping to increase the comfort and safety of the bracelet 700.

Figure 13B:
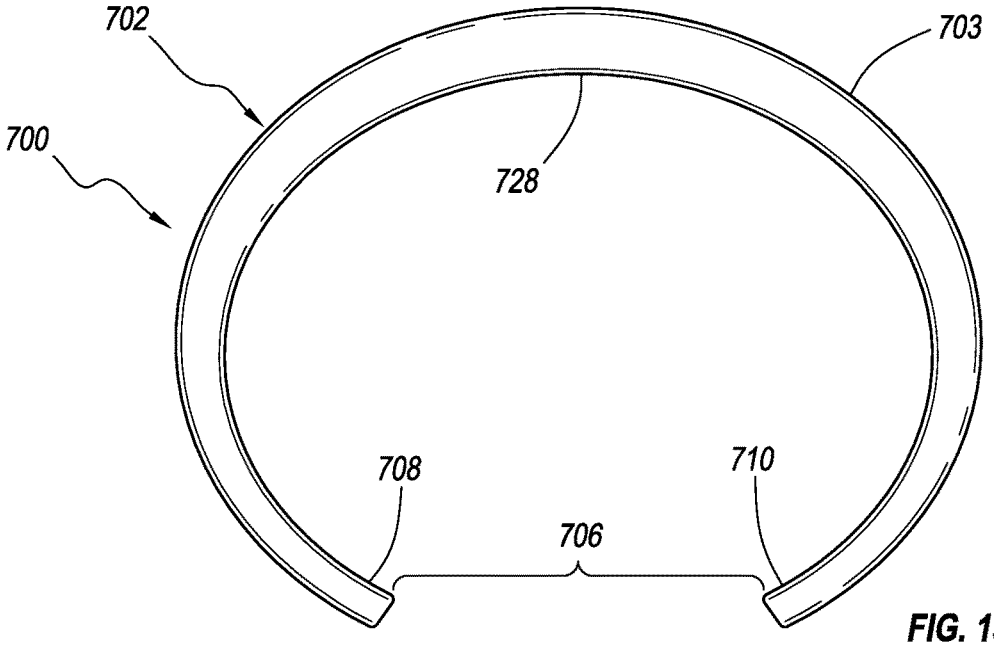
FIG. 13B is a side view of the embodiment of FIG. 13A.

The main body 702 can have any suitable shape but is shown having a semi-elliptical or oval profile as seen in FIG. 13B. The main body 702 defines an inner surface 728 arranged to be worn against the wrist. The inner surface 728 can have an anatomical shape arranged to more natural fit over a user's wrist.

At least one hair accessory 704, such as a hair tie or elastic band, is adapted to extend over the main body 702 and arranged to be secured by the at least one retaining feature 712. The main body 702 retains the hair accessory 704 therewith and the hair accessory 704 spans the periphery of the main body 702 and the clearance 706.

Similar to the previously described embodiments, the semi-rigid or rigid main body 702 is arranged to resist the elasticity of the at least one hair accessory 704 without deformation. For instance, the main body 702 can substantially maintain its shape under the force created by the tension of the hair accessory 704 and lift the at least one hair accessory 704 off the user's wrist or allow it to only apply a minimal or desirable amount of pressure in certain areas wherein the bracelet 700 does not cover the arm. The main body 702 also provides the advantage of distributing from the force created by the tension of the hair accessory 704, partially or completely around the wrist.

The main body 702 can have a malleable or resilient configuration, allowing it to be formed or shaped to accommodate an individual's wrist. For instance, the main body 702 can be formed of a metal material shapeable or pliable without breaking or cracking to fit the user's wrist (e.g., gold, platinum, copper, aluminum, etc.) while also having a rigidity arranged to maintain the shape of the main body 702 under the force of the hair accessory 704 and to lift the hair accessory 704 off the user's wrist.

In other embodiments, the main body 702 can be formed of a resin (e.g., plastic) and/or metal material having a resilient configuration such that the opposing end portions 708, 710 can be moved or flexed apart to help position the main body 702 on the user's wrist while also having a rigidity arranged to maintain the shape of the main body 702 under the force of the hair accessory 704. As such, the bracelet 700 can protect the user's arm or wrist from poor blood circulation, pressure marks, and provide a carrier to maintain hair accessories.

The at least one retaining feature 712 may be a groove 712 formed into the outer surface 703 of the main body 702 and extending about its length or circumference. The groove 712 is shown in FIG. 13C having a substantially quadrilateral or rectangular cross section but may have any shape suitable to retain the hair accessory therein.

The groove 712 can define a pair of flat upstanding sidewalls 718 and a flat bottom portion 720 extending between the sidewalls 718. It should be appreciated that the groove 712 can define a chamfer or fillet between the bottom portion 720 and the sidewalls 718 and/or between the sidewalls 718 and the outer surface 703 of the main body 702.

The flatness of the bottom portion 720 along its cross section results in the compressive pressure from the hair accessory 704 being substantially perpendicular to the bottom of the groove 712. This in effect maintains the force of the hair accessory 704 substantially normal to the bottom of the groove 712, which, in turn, reduces the likelihood of the hair accessory 704 forcing or pulling itself toward one side or the other within the groove 712, helping to keep the hair accessory 704 in the groove 712 and on the bracelet 700. The groove 712 defines a width Gw between the sidewalls 718 to ensure that the hair accessory 704 does not slip from the bracelet 700 and therefore proper distribution of pressure from the hair accessory is ensured. The width Gw can be greater than a width of the hair accessory 704. The width Gw can be constant. The width Gw can vary. Optionally, the transition between the bottom portion 720 and the sidewalls 718 can define a radius.

Figure 13C:
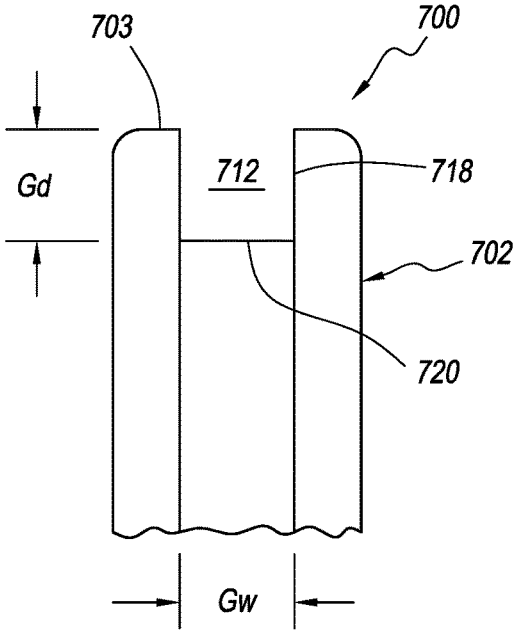
FIG. 13C is a front sectional view of the embodiment of FIG. 13A.
Figure 13D:
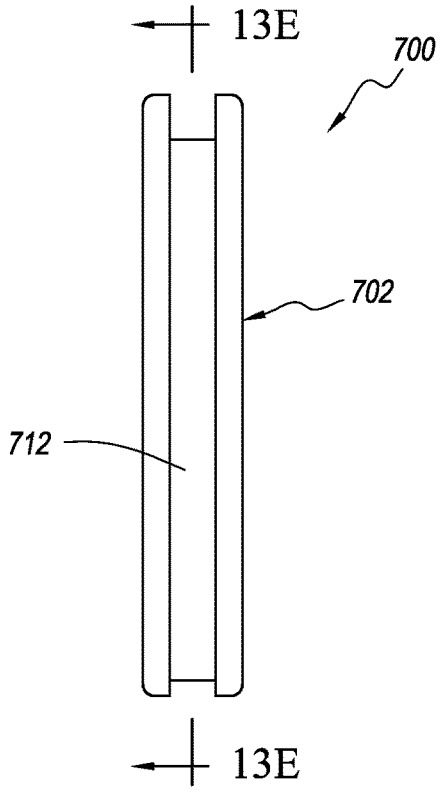
FIG. 13D is a front view of the embodiment of FIG. 13A.
Figure 13E:
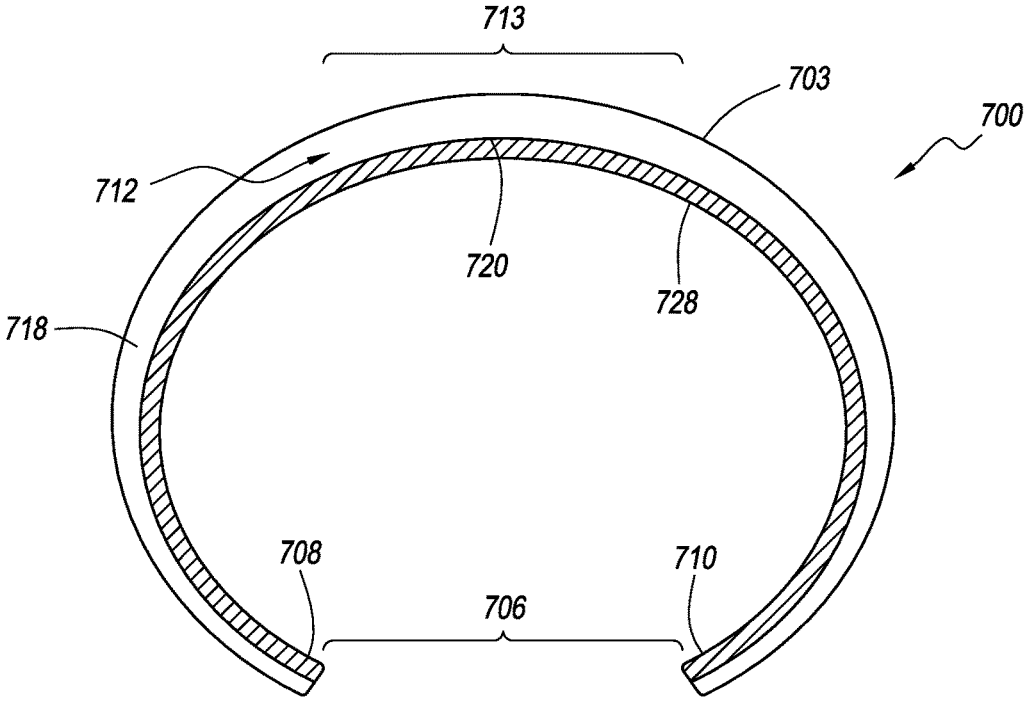
FIG. 13E is a cross-sectional view taken along line 13E-13E shown in FIG. 13D.

Referring to FIGS. 13C-13E, the groove 712 has a depth Gd defined between the bottom portion 720 and the outer surface 703 of the main body 702. The magnitude of the depth Gd relative to the width Gw can be selected to help retain the hair accessory 704 in the groove 712. The depth Gd can be greater than about 0.8, about 1, about 1.2, about 1.4, about 1.6, about 1.8, or about 2 times the width Gw of the groove 712. In other embodiments, the depth Gd relative to the width Gw of the groove 712 can be greater or smaller.

The depth Gd of the groove 712 can generally correspond to a height of the sidewalls 718. In an embodiment, the depth Gd of the groove 712 can be selected to reduce the likelihood of the hair accessory 704 jumping or moving along the sidewalls 718 and out of the groove 712. In an embodiment, the depth Gd of the groove 712 can be greater than about 0.3, about 0.5, about 0.7, about 0.9, about 1, about 1.2, about 1.4, about 1.6, about 1.8, or about 2 times the cross-sectional height of a hair accessory disposed in the groove 712. This provides a greater contact surface between the sidewalls 718 and the hair accessory while the hair accessory is disposed in the groove 712, helping to retain the hair accessory within the groove. In other embodiments, the depth Gd can be greater or smaller relative to the cross-sectional height of the hair accessory.

Furthermore, the sidewalls 718 can be substantially perpendicular to the bottom portion 720. This allows the sidewalls 718 to provide greater resistance to movement of the hair accessory out of the groove 712 as sidewalls 718 are more difficult for the hair accessory to climb or move along than a sloped or curving sidewall.

According to a variation, the groove 712 has a varying depth Gd. As seen in FIG. 13E, the depth Gd of the groove 712 can increase from the ends portions 708, 710 toward a middle portion 713 of the groove 712 generally opposite the clearance 706*t*. The depth Gd of the groove 712 at or near the middle portion 713 can be greater than about 1.2, about 1.4, about 1.6, about 1.8, about 2, or about 2.2 times the depth Gd of the groove 712 at or near the end portions 708, 710. In other embodiments, the depth Gd of the groove 712 at or near the middle portion 7*d*13 can be greater or smaller relative to the depth Gd of the groove 712 at or near the end portions 708, 710.

The groove 712 can define a greater depth Gd where the radius of curvature of the groove 712 and the main body 702 is larger, across the top of the wrist. This advantageously can help hide more of the hair accessory in the groove 712 where it is most visible to a casual observer, providing an aesthetically pleasing look. It can also more securely retain the hair accessory in the groove 712 by locating the hair accessory deeper in the groove 712, reducing the likelihood of inadvertent displacement by bumping, rubbing, or the like. In other embodiments, the maximum depth Gd of the groove 712 can be defined toward the end portions 708, 710 or along the sides of the main body 702.

Figure 14:
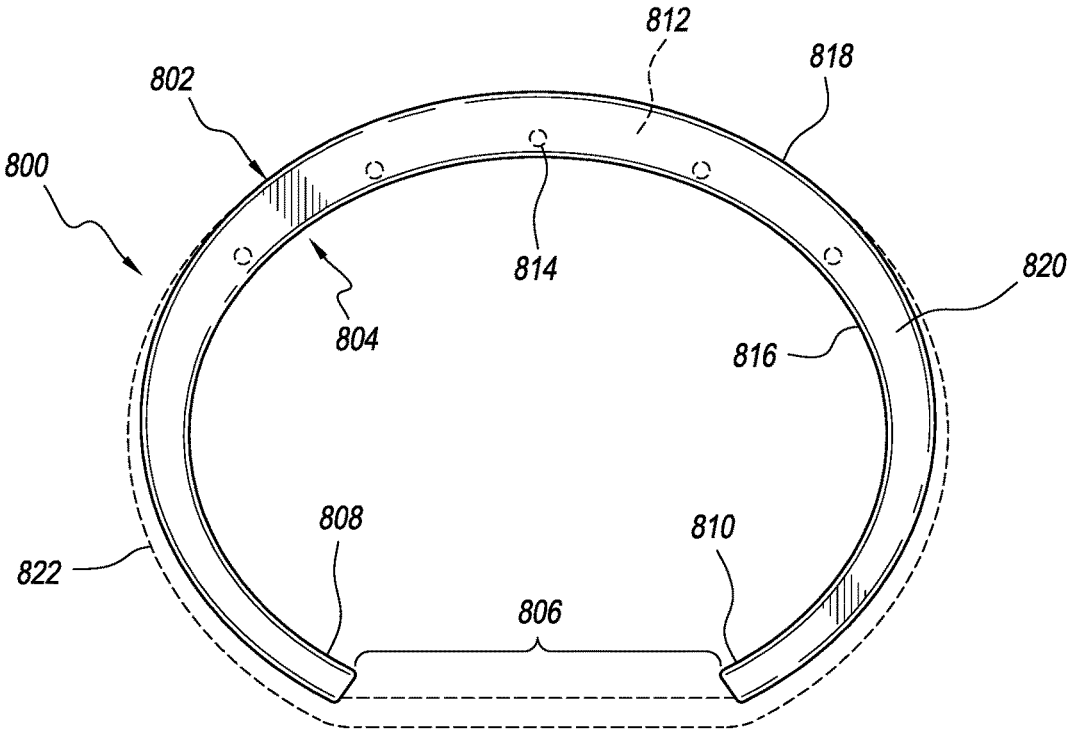
FIG. 14 is a side view showing another embodiment of a versatile jewelry.

In other embodiments, the retaining feature can comprise magnets inserted into bracelet. For instance, FIG. 14 shows an embodiment of a versatile jewelry 800 comprising a bracelet including a main body 802 and a retaining feature 804. Similar to other embodiments, the main body 802 can define first and second opposing ends 808, 810 with a clearance 806 therebetween to form an open cuff design. The clearance 806 is sized and configured to receive the wrist when the main body 802 is donned on the wrist. The main body 802 defines an inner surface 816 arranged to be worn against the wrist, an outer surface 818 opposite the inner surface 816, and side surfaces 820 extending between the inner and outer surfaces 816, 818.

The retaining feature 804 can comprise a groove 812 formed in the outer surface 818 or any other surface of the main body 802 and extending about its length or circumference. For instance, the groove 812 can be formed in a side surface 820 of the main body 802. This advantageously helps conceal a hair accessory and allows the outer surface 818 to be used only for decorative purposes.

The groove 812 can have a quadrilateral cross section or any other suitable cross-sectional shape to retain a hair accessory, such as a hair tie or elastic band, therein. For instance, the groove 812 can have a triangular or concave cross-section. The hair accessory can have an elliptical, circular, or quadrilateral cross-sectional shape.

The retaining feature 804 can comprise one or more permanent magnets 814 and/or ferromagnetic material. The permanent magnets 814 can be inserted in corresponding holes defined in the side surfaces 820 of the main body 802. The permanent magnets 814 can be embedded in the main body 802. The permanent magnets 184 may be attached to the main body 802 within the groove 812. The permanent magnets 814 may be located in the main body 802 below the groove 812. The permanent magnets 814 may be circumferentially distributed on the main body 802.

According to a variation, a hair accessory 816 can include one or more corresponding permanent magnets and/or ferromagnetic material. In use, the hair accessory 816 is held in the groove 812 by magnetic attraction between the main body 802 and the hair accessory 816 when the hair accessory 816 is disposed in the groove 812. This beneficially increases the connecting forces between the main body 802 and the hair accessory 816, improving the securement of the hair accessory 816 on the main body 802.

Further, the magnetic force or attraction between the hair accessory 816 and the main body 802 can be customized. For instance, the magnetic strength of the permanent magnets 814 can be selected to increase the magnetic attraction between the hair tie and the main body 802 for higher levels of activity such as sports or dancing.

Optionally, the groove 812 may be omitted. For instance, the one or more permanent magnets 814 and/or the ferromagnetic material may be included in the main body 802 and the magnetic force or attraction between the hair accessory 816 and the main body 802 can secure the hair accessory 816 against an outer surface 818 or a side surface 820 of the main body 802. In another variation, the main body 802 may include one or more ferromagnetic materials and the hair accessory 816 may include permanent magnets and/or magnetic materials. In other embodiments, the permanent magnets 814 and/or ferromagnetic material can be arranged to hold two or more bracelets together. This advantageously allows multiple bracelets to stack together.

Figure 15:
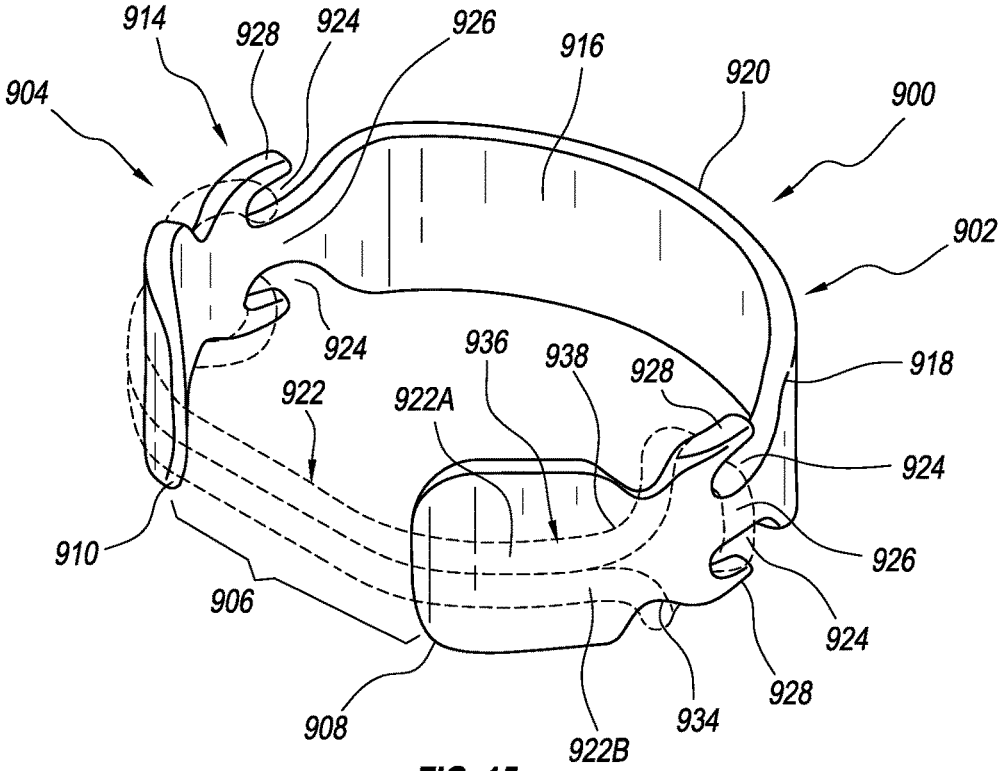
FIG. 15 is a perspective view showing another embodiment of a versatile jewelry.

In other embodiments, the retaining feature can comprise one or several hooks on the bracelet. For example, FIG. 15 shows an embodiment of a versatile jewelry 900 comprising a bracelet including a main body 902 and a retaining feature 904. The main body 902 can define first and second opposing ends 908, 910 with a clearance 906 therebetween to form an open cuff design. The clearance 906 can be sized and configured to receive the wrist when the main body 902 is donned on the wrist. The main body 902 defines an inner surface 916 arranged to be worn against the wrist, an outer surface 918 opposite the inner surface 916, and side surfaces 920 extending between the inner and outer surfaces 916, 918. A width of the main body 902 is defined between the side surfaces 920 and a depth of the main body 902 is defined between the inner and outer surfaces 916, 918. The main body 902 can have a rigid or semi-rigid configuration arranged to resist the elasticity of at least one hair accessory 922, such as a hair tie or elastic band, without deformation.

In the illustrated embodiment, the depth of the main body 902 is relatively smaller than the width of the main body 902. For instance, the depth of the main body 902 be between about 0.1 and about 0.6, or about 0.2 and about 0.4 times the width of the main body 902. This allows the bracelet 800 to be low profile by sitting close to the wrist.

The retaining feature 904 can comprise a plurality of hook members 914 defined on the main body 902. In use, the hair accessory 922 can be fitted on the hook members 914 such that multiple lengths of the hair accessory 922 spans the clearance 906 and the hook members 914 secure the hair accessory 922 on the main body 902. The hair accessory 922 does not span the periphery of the main body 902 opposite the clearance 906, advantageously lowering the overall profile the bracelet 900. Moreover, the tension of the hair accessory 922 forces or tightens the hair accessory 922 against and/or around the hook members 914, reducing the likelihood of inadvertent displacement of the hair accessory 922 from the hook members 914 by bumping, rubbing, or the like.

In an embodiment, first cutouts 924 in the side surfaces 920 define a first narrowed portion 926 of the main body 902 and a hook part 928 of the hook member 914 extending away from the opposing ends 908, 910. The first and cutouts 924 can have irregular and/or regular geometric shape. Second upper and lower cutouts 930 in the side surfaces 920 define a second narrowed portion 932 and an angled or curved surface 934 on the hook member 914 opposite the hook part 928. The width of the second narrowed portion 932 is greater than the width of the first narrowed portion 926.

According to a variation, the retaining feature 904 can comprise a groove 936 formed in the outer surface 918 between the second narrowed portion 932 and one of the opposing ends 908, 910. The groove 936 advantageously directs the hair accessory 922 across and the clearance 906 between the opposing ends 908, 910. Further, the groove 936 beneficially helps limit the hair accessory 922 from sliding or slipping along the outer surface 918 of the main body 902 toward the side surfaces 920 between the second narrowed portion 932 and the opposing ends 908, 910.

The groove 936 can have a constant width or a varying width. For instance, an end portion of the groove 936 toward the hook members 914 can be widened or define a curvature or radii 938 to facilitate insertion of the hair accessory 922 in the groove 936. A depth of the groove 936 between the outer surface 918 and a bottom of the groove 936 can be constant or can vary. For instance, a length of the groove 936 toward the end 908 or 910 can have a depth that tapers toward the end. The varying depth can be defined by angled or curved part of the outer surface 918 extending toward the inner surface 916 and one of the ends 908, 910.

In use, the hair accessory 922 is configured as a continuous loop and one end of the hair accessory 922 is positioned across the outer surface 918 on the first narrowed portion 926 such that a first length 922A of the hair accessory 922 passes between the hook part 928 and the first narrowed portion 932 on one side of the first narrowed portion 926 and a second length 922B of the hair accessory 922 passes between the hook part 928 and the first narrowed portion 932 on the opposite side of the first narrowed portion 926 opposite the first length 922A.

From there, the first and second lengths 922A, 922B extend along the inner surface 916 in a direction toward the opposing ends 908, 910, over the inclined or curved surfaces 934, and back onto the outer surface 918 across the second narrowed portion 932. The radii 938 then directs both the first and second lengths 922A, 922B of the hair accessory 922 on the outer surface 918 together and through the groove 936, which, in turn, directs the first and second lengths 922A, 922B across the clearance 906 toward and through the groove 936 defined in the opposing end 910.

From the groove 936 on the opposing end 910, the first and second lengths 922A, 922B of the hair accessory 922 run along the radii 938 formed on the outer surface 918, diverging from one another across the angled or curved surfaces 934 and back onto the inner surface 916. From the inner surface 916, the first and second lengths 922A, 922B pass between the hook parts 928 and the first narrowed portion 926, and back across the outer surface 918, where they connect to form an opposite end of the hair accessory 922.

The hair accessory 922 can thus be fitted on the hook members 914 such that multiple lengths of the hair accessory 922 spans the clearance 906, and the hook members 914 in combination the grooves 936 secure the hair accessory 922 on the main body 902. The tension of the hair accessory 922 forces or tightens the hair accessory 922 against and/or around the hook members 914. Further, the tension in the hair accessory 922 forces the hair accessory 922 against the bottom of the grooves 936, reducing the likelihood of inadvertent displacement of the hair accessory 922 from the main body 902.

Figure 16A:
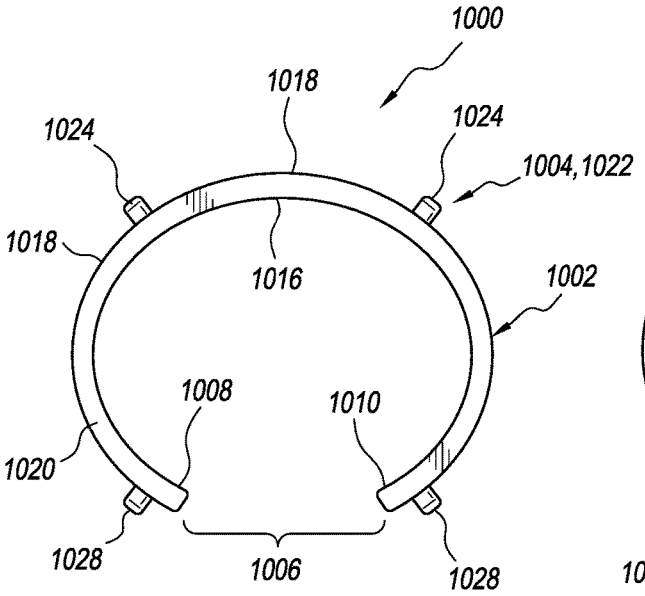
FIG. 16A is a side view showing another embodiment of a versatile jewelry.
Figure 16B:
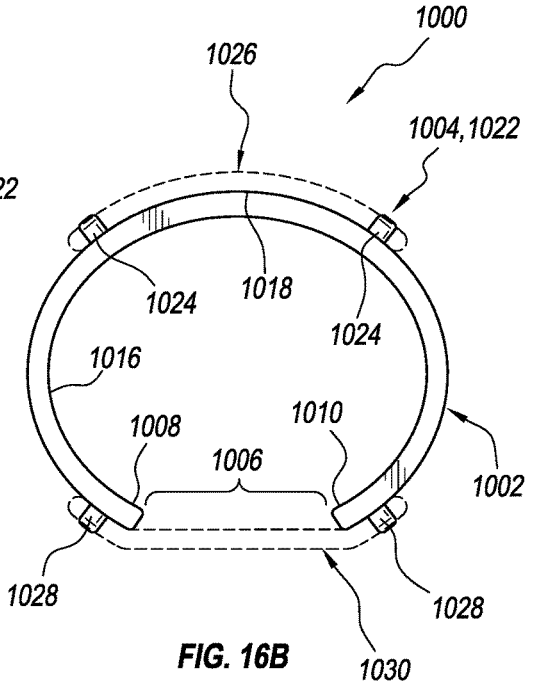
FIG. 16B is a side view of the versatile jewelry in FIG. 16A with a pair of hair accessories secured thereto.
Figure 16C:
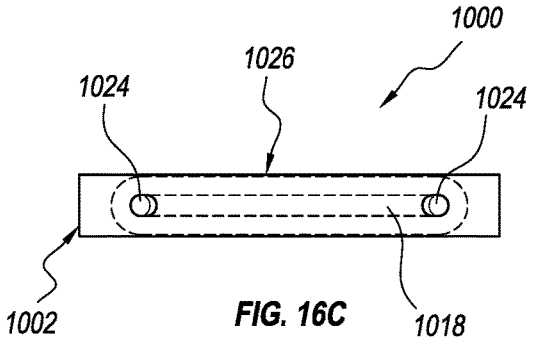
FIG. 16C is a top view of the versatile jewelry in FIG. 16A.

FIGS. 16A-16C shows a versatile jewelry 1000 comprising a bracelet including a main body 1002 and at least one retaining feature 1004 according to yet another embodiment. The main body 1002 can define first and second opposing ends 1008, 1010 with a clearance 1006 therebetween to form an open cuff design. The clearance 1006 is sized and configured to receive the wrist when the main body 1002 is donned on the wrist. The main body 1002 defines an inner surface 1016 arranged to be worn against the wrist, an outer surface 1018 opposite the inner surface 1016, and side surfaces 1020 extending between the inner and outer surfaces 1016, 1018. In other embodiments, the main body 1002 can be arranged as a fully circumferential cuff.

At least one hair accessory, such as a hair tie or elastic band, is adapted to extend over the main body 1002 and arranged to be secured by the at least one retaining feature 1004 on the main body 1002. The at least one retaining feature 1004 can comprise a plurality of attachment points 1022 on the main body 102.

The attachment points 1022 are shown included on the outer surface 1018 however in other embodiments the attachment points 1022 can be formed on one or more of the side surfaces 1020 or inner surface 1016 of the main body 1002. The attachment points 1022 can comprise hook members having an elongate configuration arranged to grab a hair accessory. The attachment points 1022 can comprise hook members with a wide configuration arranged to form a platform or contact surface that engages and holds a hair accessory.

In an embodiment, the attachment points 1022 can include a first pair of hook members 1024 extending radially outward from the outer surface 108. The first hook members 1024 can be positioned generally opposite the opposing ends 1008, 1010. The first hook members 1024 can comprise post members, protrusions, and/or crook members, angle members, or any other suitable member. It will be appreciated that the attachment points or hook members can be on the top outer surface or any other surface on the bracelet 1000.

Referring to FIGS. 16B and 16C, the at least one hair accessory can comprise a hair tie 1026 arranged to be positioned or loaded on the first hook members 1024 such that opposing portions of the hair tie 1026 engage the first hook members 1024 and the hair tie 1026 spans the distance between the first hook members 1024 on the outer surface 1018 opposite the clearance 1006. The first hook members 1024 are spaced such that when the hair tie 1026 is positioned on the first hook members 1024 it is in tension. The elasticity of the hair tie 1026 forces the hair tie 1026 against the first hook members 1024, which are arranged to resist the elasticity of the hair tie 1026. As such, the compressive force on the first hook members 1022 from the hair tie 1026 helps secure the hair tie 1026 against the rigid or semi-rigid hook members 1024. Further, the main body 1002 lifts the hair tie 1026 off the user's wrist and directs the hair tie 1026 between the first hook members 1024. The main body 1002 and first hook members 1024 also provides the advantage of distributing from the force created by the tension of the hair tie 1026.

In an embodiment, a method for removing the hair tie 1026 involves pulling the hair tie 1026 from the span between the first hook members 1024 and disengaging the hair tie 1026 from the first hook members 1024 to pull the hair tie 1026 away from the outer surface 1018 of the main body 1002.

The first hook members 1024 have a height defined between the outer surface 1018 of the main body 1002 and an end of the first hook members 1024 radially spaced from the outer surface 1018. The height of the first hook members 1024 can be selected to reduce the likelihood of the hair tie 1026 jumping or slipping upward and off the hook members 1024. According to a variation, the height of the first hook members 1022 can be greater than about 0.3, about 0.5, about 0.7, about 0.9, about 1, about 1.2, about 1.4, about 1.6, about 1.8, or about 2 times the cross-sectional height of a hair tie on the outer surface 1018 of the main body 1002. This provides a greater contact surface between the first hook members 1024 and the hair tie 1026, helping to retain the hair tie 1026 on the main body 1002. In other embodiments, the height of the first hook members 1024 can be greater or smaller relative to the cross-sectional height of the hair tie 1026.

According to a variation, the attachment points 1022 can include a second pair of hook members 1028 on the outer surface 1018 at or near the opposing ends 1008, 1010. The second hook members 1028 can be arranged similar to the first hook members 1024 or can be different from the first hook members 1024. The first hook members 1022 can comprise post members, protrusions, and/or crook members, angle members, or any other suitable member.

The at least one hair accessory can comprise a second hair tie 1030 can be positioned on the second hook members 1028 such that opposing portions of the second hair tie 1030 engage the second hook members 1028 and the second hair tie 130 spans the clearance 1006. Similar to the first hook members 1024, the second hook members 1028 can be spaced apart such that when the second hair tie 1030 is positioned on the second hook members 1028 it is in tension. The second hair tie 1030 spanning the clearance 1006 is arranged to facilitate disengagement of the second hair tie 1030 from the second hook members 1028.

Further, the main body 1002 lifts the second hair tie 1030 off the user's wrist and directs the second hair tie 1030 between the second hook members 1028. The main body 1002 and second hook members 1028 also provides the advantage of distributing from the force created by the tension of the second hair tie 1030.

In an embodiment, a method for removing the second hair tie 1030 involves pulling the second hair tie 1030 from the clearance 1006 and disengaging the second hair tie 1030 from the second hook members 1028 to pull the hair tie 1030 away from the main body 1002. The second hair tie 1030 may be eventually pulled over the hand to use for the user's hair.

It will be appreciated that one or more hair accessories or one or more hair ties can be loaded on the attachment points 1022 in any suitable manner. For instance, a hair tie can be positioned on one of the second hook members 1028 and one of the first hook members 1024 such that the hair tie extends along the outer surface 1018 on a side of the main body 1002. In other embodiments, the hook members can be arranged to retain a key or charms for aesthetic purposes. In other embodiments, one or more of the hook members can be located in a groove formed in the main body 1002.

Figure 17A:
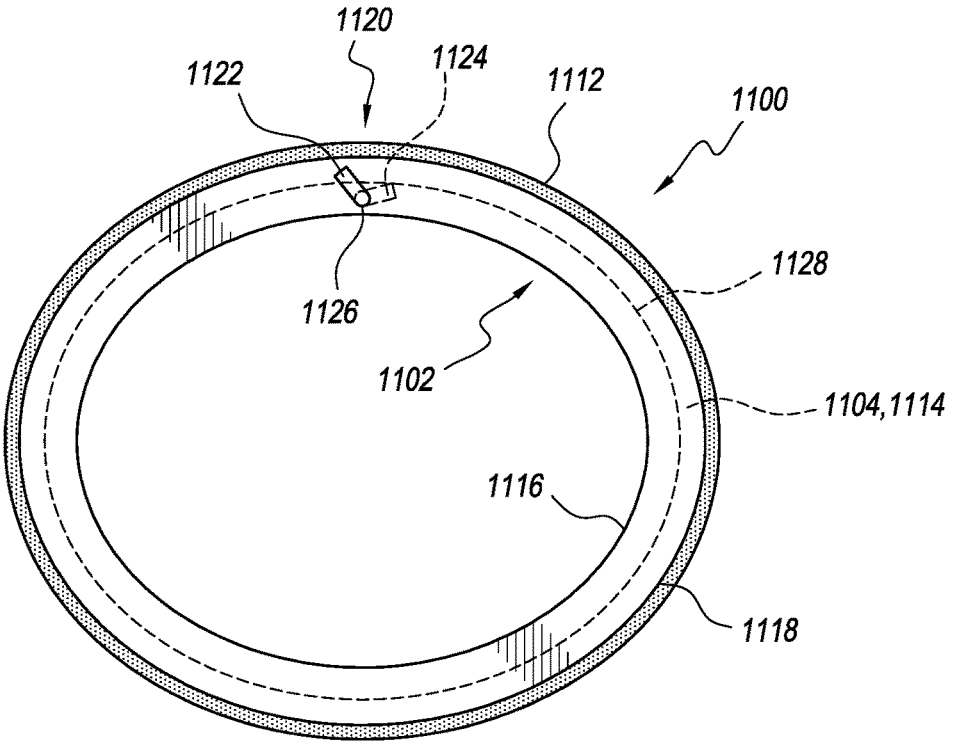
FIG. 17A is a side view showing another embodiment of a versatile jewelry.
Figure 17B:
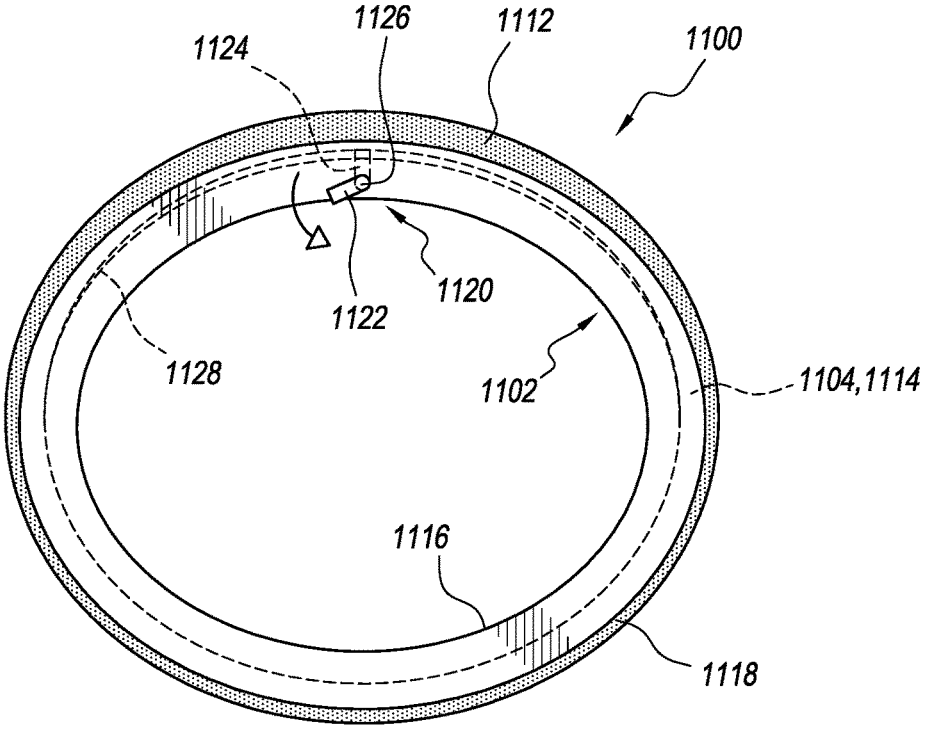
FIG. 17B is another side view showing the versatile jewelry of FIG. 17A.

As discussed above, embodiments of the versatile jewelry can be configured as a closed cuff or a fully circumferential bracelet. For instance, FIGS. 17A and 17B illustrate a versatile jewelry 1100 comprising a closed cuff or a fully circumferential bracelet. The bracelet 1100 can include a main body 1102 and at least one retaining feature 1104 defined about the outer periphery thereof. The main body 1102 can have any suitable shape but is shown having an oval or elliptical profile. The main body 1110 defines an inner surface 1116 arranged to be worn against the wrist and an outer surface 1118 opposite the inner surface 1116.

At least one hair accessory 1112, such as a hair tie or elastic band, is adapted to extend over the main body 1102 and arranged to be secured by the at least one retaining feature 1104. The hair accessory 1112 spans the periphery of the main body 1102 and the main body 1102 has a rigid or semi-rigid configuration arranged to resist the elasticity of the hair accessory 1112.

The retaining feature 1104 comprises a groove 1114 formed in the outer surface 1118 of the main body 1102 and extending about all or some of its length of circumference. The groove 1114 can have a substantially quadrilateral or rectangular cross section. The groove 1114 can have a concave shape, a triangular shape, or any other shape suitable to retain the hair accessory 1112 therein. In the illustrated embodiment, the groove 1114 has a constant depth. In other embodiments, the groove 114 can have a varying depth.

At least one release mechanism or feature 1120 is arranged to facilitate disengagement or removal of the hair accessory 1112 from the groove 1114. In the illustrated embodiment, the release feature 1120 can comprise an actuator 1122, a push member 1124, and a pin member 1126 connecting the actuator 1122 and the push member 1124 and extending into an opening in the main body 1102. The actuator 1122 and the push member 1124 are pivotally connected to the main body 1102 via the pin member 1126 and are arranged to pivot or rotate together above the pin member 1126. The actuator 1122 is accessible from the outside of the main body 1102 and the push member 1124 is positionable within the groove 1114. The release feature 1120 is movable or rotatable between an original position (shown in FIG. 17A) in which a free end of the push member 1124 is located at or below a bottom surface 1128 of the groove, and a release position (shown in FIG. 17B) in which the free end of the push member 1124 is located above the bottom surface 1128 of the groove 1114. Optionally, the release feature 1120 can be biased toward the original position. The actuator 1122 can comprise a lever, a cam member button, or any other structure suitable to move the release feature 1120 between the original and release positions.

In use, when the release feature 1120 is in the original position, the hair accessory 1112 can extend over the release feature 1120 at or along the bottom surface 1128 of the groove 1114. This helps to maintain the hair accessory 1112 within the groove 1114 by locating the hair accessory 1112 deep within the groove 1114, reducing the likelihood of inadvertent displacement by bumping, rubbing, or the like.

To disengage or remove the hair accessory 1112 from the bracelet 1100, a user can rotate the actuator 1122 relative to the main body 1102, which, in turn, rotates the push member 1124 within the groove 1114, moving the release feature 1120 toward the release position. This causes the free end of the push member 1124 to engage and lift the hair accessory up and at least partially out of the groove 1114 in the area of the release feature 1120, advantageously facilitating disengagement or removal of the hair accessory 1112 from the groove 1114. It should be appreciated that the release feature 1120 is exemplary only and other release features are possible.

FIGS. 18A and 18B illustrate another embodiment of a versatile jewelry 1200 comprising a closed cuff or a fully circumferential bracelet. The bracelet 1200 can include a main body 1202 and at least one retaining feature 1204 defined about the outer periphery thereof. The main body 1202 can have any suitable shape but is shown having an oval or elliptical profile. The main body 1202 defines an inner surface 1216 arranged to be worn against the wrist and an outer surface 1218 opposite the inner surface 1216. The inner surface 1216 can have an anatomical shape arranged to more natural fit over a user's wrist.

The main body 1202 includes a lower section 1222 arranged to be worn under the bottom of the user's wrist and an upper section 1224 arranged to be worn over the top of the wrist. The main body 1202 is sized and configured such that a user can pass the main body 1202 over the hand and onto the wrist.

In the illustrated embodiment, a width of the main body 1202 defined between the inner and outer surfaces 1216, 1218 can be greater along the upper section 1224 than the lower section 1222. To reduce the likelihood of the main body 1202 rotating in a disadvantageous way on the wrist, the thinner lower section 1222 can be arranged to have a same or similar weight as the thicker upper section 1224.

At least one hair accessory 1212, such as a hair tie or elastic band, is adapted to extend over the main body 1202 and arranged to be secured by the at least one retaining feature 1204. The hair accessory 1212 spans the periphery of the main body 1202 and the main body 1202 has a rigid or semi-rigid configuration arranged to resist the elasticity of the hair accessory 1212.

The retaining feature 1204 comprises a groove 1214 formed in the outer surface 1218 of the main body 1202 and extending about all or some of its length or circumference. The groove 1214 can have a substantially quadrilateral or rectangular cross section. The groove 1214 can have a concave shape, a triangular shape, or any other shape suitable to retain the hair accessory 1212 therein.

The groove 1214 has a bottom portion 1220 and defines a depth Rd defined between the bottom portion 1220 and the outer surface 1218 of the main body 1202. The magnitude of the depth Rd relative to a cross-sectional height of the hair accessory 1212 can be selected to help retain the hair accessory 1212 in the groove 1214. More particularly, the depth Rd of the groove 1214 can be selected to reduce the likelihood of the hair accessory 1212 jumping or moving along sidewalls of the groove 1214 and out of the groove 1214.

In the illustrated embodiment, the groove 1214 has a varying depth Rd. The depth Rd of the groove 1214 can be arranged such that the hair accessory 1212 is partially or fully covered or hidden with the groove 1214 except for a short distance wherein the hair accessory 1212 is completely exposed with minimal to no groove so that a user can more easily grab the hair accessory 1212.

The depth Rd of the groove 1214 can increase from the lower section 1222 toward the upper section 1224 over the top of the wrist. This advantageously can help hide more of the hair accessory 1212 in the groove 1214 where it is most visible to a casual observer, providing an aesthetically pleasing look. It can also more securely retain the hair accessory 1212 in the groove 1214 by locating the hair accessory 1212 deeper in the groove 1214, reducing the likelihood of inadvertent displacement by bumping, rubbing, or the like.

The variable depth Rd of the groove 1214 can also help facilitate disengagement of the hair accessory 1212 from the groove 1214. For instance, the depth Rd of the groove 1214 along the lower section 1222 can be zero, near-zero, or very minimal to provide a user direct access to the hair accessory 1212. In an embodiment, a method for removing the hair accessory 1212 involves pulling the hair accessory 1212 from the lower section 1222 of the main body 1202 and disengaging the hair accessory 1212 from the groove 1214 to pull the hair accessory 1212 away from the outer surface 1218 of the main body 1202.

FIGS. 19A and 19B show a versatile jewelry 1300 comprising a closed cuff or a fully circumferential bracelet. The bracelet 1300 can be similar to the bracelet 1200 including a main body 1302 and at least one retaining feature 1304 defined about the outer periphery thereof. The main body 1302 defines an inner surface 1316 and an outer surface 1318 opposite the inner surface 1316.

At least one hair accessory 1312, such as a hair tie or elastic band, is adapted to extend over the main body 1302 and arranged to be secured by the at least one retaining feature 1304. The main body 1302 retains the hair accessory therewith and the hair accessory 1312 spans the periphery of the main body 1302. The main body 1302 can have a rigid or semi-rigid configuration arranged to resist the elasticity of the hair accessory 1312.

The at least one retaining feature 1304 may be a groove 1314 formed in the outer surface 1318 of the main body 1302. The groove 1314 can extend about a length or circumference of the main body 1302. The groove 1314 can have a rectangular cross-section, a trapezoidal cross-section, a concave cross-section, a triangular cross-section, and/or any other shape suitable to help secure the hair accessory 1312 in the groove 1314.

As seen, the main body 1302 has a generally elliptical or circular profile with a release feature 1324 comprising a release segment 1326 extending between first and second ends or end portions 1308, 1310. The segment 1326 at least in part defines a clearance 1306 between the end portions 1308, 1310 and can bring the main body 1302 inwards toward the wrist at a defined location along a length of the main body 1302. The segment 1326 is shown being concave but can have any suitable shape. The clearance 1306 formed by the segment 1326 advantageously provides a space or area to allow fingers to grab the hair accessory 1312 and remove it from the bracelet 1300, facilitating removal of the hair accessory 1312 from the bracelet 1300. The groove 1314 can extend along the segment 1326. The grove can terminate short of the segment 1326.

According to a variation, the segment 1326 is arranged to shift between a normal position, in which the segment 1326 is convex and/or extends along the elliptical or circular profile of the main body 1302, and an inward position, in which the segment 1326 is concave and/or extends radially inward below the outer surface 1318 and/or inner surface 1316 of the main body 1302 (shown in FIG. 19B).

According to a variation, the segment 1326 can be a release spring mechanism arranged to resiliently move toward and lock in the normal position. In an embodiment, the segment 1326 in the normal position can force at least a portion of the hair accessory 1312 from the groove 1314. A user can push on the segment 1326 to move the segment 1326 toward the normal position, which, in turn, can pop or move the hair accessory 1312 out of at least a portion of the groove 1314.

The location and/or the amount the main body 1302 flexes or moves through the segment 1326 can be controlled by varying the thickness of the main body 1302 and/or by changing the cross-sectional area or shape of the main body 1302 in the segment 1326. For instance, a thickness of the main body 1302 through the segment 1326 can be reduced to increase flexibility. It will be appreciated that the main body 1302 can include one or more segments.

In an embodiment, a method for removing the hair accessory 1312 involves moving the segment 1326 to the inward position and pulling the hair accessory 1312 from the clearance 1306 and disengaging the hair accessory 1312 from the groove 1314 to pull the hair accessory 1312 away from the outer surface 1318 of the main body 1302. While being donned and worn, the segment 1326 can be moved into or biased toward the normal position, increasing ease of donning and user comfort.

FIG. 20 illustrates yet another embodiment of a versatile jewelry 1400 comprising a bracelet including a main body 1402 and a retaining feature 1404. The main body 1402 can define first and second opposing ends 1408, 1410 with a clearance 1406 therebetween to form an open cuff design. The main body 1402 includes an inner surface 1406 arranged to be worn against the wrist, and an outer surface 1418 opposite the inner surface 1416.

At least one hair accessory 1412, such as a hair tie or elastic band, is adapted to extend over the main body 1402 and arranged to be secured by the at least one retaining feature 1404 on the main body 1402. The retaining feature 1404 can comprise a groove 1414 formed in the outer surface 1418 or another surface of the main body 1402. The hair accessory 1412 selectively spans a circumference of the main body 1402 in the groove 1414 and the clearance 1406. The groove 1414 can have any cross-sectional shape suitable to help retain the hair accessory 1412 in the groove 1414. The hair accessory 1412 spanning the clearance 1406 is arranged to facilitate disengagement or removal of the hair accessory 1412 from the groove 1414.

The clearance 1406 can have a variable width. For instance, the main body 1402 can be segment into a first part 1420 and a second part 1422. The first and second parts 1420, 1422 are arranged to rotate around a pivot point 1424. The pivot point 1424 can be a hinge, a pin member, or any other suitable pivot mechanism.

The main body 1402 is movable between an open position, in which the ends 1408, 1410 rotate about the pivot point 1424 away from each other to increase a width of the clearance 1406, and a closed position, in which the ends 1408, 1410 rotate about the pivot point 1424 toward each other from the open position to reduce the width of the clearance 1406. In the open position, the width of the clearance is sized and arranged to allow the wrist to pass therethrough, facilitating donning of the bracelet 1400. In the closed position, the width of the clearance 1406 is too small to allow the wrist to pass therethrough, helping to maintain the bracelet 1400 on the wrist while the bracelet 1400 is being worn.

In addition, because the main body 1402 can move between the open and closed positions, the overall profile of the bracelet 1400 in the closed position can be smaller than a full circumferential bracelet because it does not need to accommodate the hand during donning. In the closed position, it can also be smaller than other open cuff bracelets because the clearance does not need to accommodate the wrist during donning. This beneficially helps reduce the likelihood of the hair accessory 1412 being overstretch, losing its elasticity, or even breaking when being positioned in the groove 1414.

As discussed above, the at least one retaining feature can comprise an overlay or another structural feature arranged to secure at least one hair accessory on the main body without a groove or channel defined in the main body. The retaining feature can comprise one or more ridges along the bracelet to ensure that one or more bands do not move in place.

For instance, the at least one retaining feature can comprise ridges or protruding portions defined as radially extending outwardly from the main body. The protruding portions are arranged to help ensure that one or more hair accessories or bands are secured on the main body. The protruding portions can extend on either side of the hair accessory to help prevent the hair accessory from slipping off the main body and restricting circulation of the wrist. The protruding portions can have any suitable length. The protruding portions can have a long, medium, and/or long length. One or more of the protruding portions can have a length extending along the entire periphery of the main body or a partial distance along the periphery.

FIGS. 21A-21C show an embodiment of a versatile jewelry 1500 comprising a bracelet including a main body 1502 and at least one retaining feature 1504. The bracelet 1500 is configured as a closed cuff or a fully circumferential bracelet. The main body 1502 can have any suitable shape such as a rectangular shape but is shown having an oval or elliptical shape. The main body 1502 defines an inner surface 1516 arranged to be worn against the wrist and an outer surface 1518 opposite the inner surface 1516.

At least one hair accessory 1512, such as a hair tie or elastic band, is adapted to extend over the main body 1502 and arranged to be secured by the retaining feature 1504. The hair accessory 1512 spans the periphery of the main body 1502 and the main body 1502 has a rigid or semi-rigid configuration arranged to resist the elasticity of the hair accessory 1512.

The retaining feature 1504 comprises a pair of ridges or protruding portions 1520 defined as radially extending outwardly from the outer surface 1518 of the main body 1502. The protruding portions 1520 can have any suitable length. In the illustrated embodiments, the protruding portions 1520 extend along a length of the outer surface 1518 arranged to be positioned over the top of the wrist. The protruding portions 1520 define a channel 1522 therebetween arranged to receive the hair accessory 1512. The outer surface 1518 forms the bottom of the channel 1522. The channel 1522 can have a quadrilateral cross section, a trapezoidal cross section, a concave cross section, a triangular cross section, or any other suitable shape to receive and secure the hair accessory 1512. The protruding portions 1520 can be generally normal to the outer surface 1518. In other embodiments, the protruding portions 1520 can angled toward one another, helping to retain the hair accessory 1512 between the walls 1520.

Embodiments of the versatile jewelry have been generally as a bracelet however in other embodiments the versatile jewelry can comprise a ring, necklace, and/or another type of accessory such as a lipstick, hair brush, belt, purse, or wallet with a retaining feature arranged to secure at least one hair accessory on the versatile jewelry. For instance, FIGS. 22A-22D illustrate another embodiment of a versatile jewelry 1600 comprising a ring including a main body 1602 and at least one retaining feature 1604.

The main body 1602 defines an inner surface arranged to be worn against a finger 1601 and an outer surface 1618 opposite the inner surface. The main body 1602 can comprise a fully circumferential bracelet. In other embodiments, the main body 1602 can define first and second opposing ends with a small clearance therebetween. The main body 1602 can be formed from any suitable material such as silver, gold, steel, plastic, rubber, leather, or combinations thereof.

At least one hair accessory 1626, such as a hair tie or elastic band, is adapted to extend over the main body 1602 and arranged to be secured by the retaining feature 1604. The hair accessory 1626 spans the periphery of the main body 1602 and the main body 1602 can have a rigid or semi-rigid configuration arranged to resist the elasticity of the hair accessory 1326.

The at least one retaining feature 1604 comprises a groove 1614 formed in the outer surface 1618 of the main body 1602. The groove 1614 can extend about a length or circumference of the main body 1602. The groove 1614 can have any suitable cross-section shape to help secure the hair accessory 1612 in the groove 1614 such as a rectangular cross-section, a trapezoidal cross-section, a concave cross-section, a triangular cross-section, or an irregular geometric cross-section.

The groove 1614 can extend about the circumference of the main body 1602 one or multiple times. For instance, the groove 1614 can include first and second segments 1614A, 1614B. On a bottom side 1602A of the main body 1602, the first and second segments 1614A, 1614B can extend generally parallel to another. From the bottom side 1602A, the segments 614A, 614B extend around to a top side 1602B of the main body 1602 where they intersect forming a saltire like shape. This arrangement effectively allows the hair accessory 1626 to be looped multiple rounds around the main body 1602 in the groove 1614, which, in turn, tensions the hair accessory 1626 on the main body 1602. The groove 1614 is described having the above path but can have any suitable path. For instance, the groove can spiral around the main body 1602 or can include rings spaced along a height or width of the ring 1600.

FIG. 23 shows another embodiment of a versatile jewelry 1700 comprising a bracelet including a main body 1702 and a retaining feature 1704. The main body 1702 defines an inner surface arranged to be worn against the wrist, an outer surface 1718 opposite the inner surface, a first side surface 1720A extending between the inner and outer surfaces 1716, 1718, and a second side surface 1720B opposite the first side surface 1720A. The main body 1702 can define first and second opposing ends with a clearance therebetween to form an open cuff design. In other embodiments, the main body 1702 can comprise a fully circumferential bracelet.

At least one hair accessory 1726, such as a hair tie or elastic band, is adapted to extend over the main body 1702 and arranged to be secured by the at least one retaining feature 1704. As seen, the retaining feature 1704 can comprise a plurality of attachment points 1722 protruding radially from the outer surface 1718 of the main body 1702. The attachment points 1722 can be configured similar to the attachment points previously described. The attachment points 1722 can be positioned along a top, side, and/or bottom region of the main body 1702.

The attachment points 1722 can be arranged in any suitable pattern. For instance, the attachment points 1722 can be distributed in a serpentine formation. In an embodiment, the hair accessory 1726 has a continuous loop or hoop configuration.

In an embodiment, the attachment points 1722 can include a first retaining element 1722A, a second retaining element 1722B, a third retaining element 1722C, a fourth retaining element 1722D, a fifth retaining element 1722E, and a sixth retaining element 1722F. The hair accessory 1726 can be positioned or loaded on the first retaining element 1722A such that two strands or lengths 1726A, 1726B of the hair accessory 1726 are oriented toward the first side 1720A of the main body 1702. The two lengths 1726A, 1726B engage the second and third attachment points 1722B, 1722C on the first side 1720A, and turn back toward the second side 1720B of the main body 1702. From there, the two lengths 1726A, 1726B engage fourth and fifth attachment points 1722D, 1722E on the second side 1720B, turn back toward the first side 1720A, and wrap around a sixth attachment points 1722F to a point where they come back together.

The first retaining element 1722A and the sixth retaining element 1722F are spaced such that when the hair accessory 1726 is positioned on the attachment points 1722 it is in tension. By threading or routing the hair accessory 1726 through the attachment points 1722, the distance of the hair accessory 1726 extends is longer, which, in turn, allows the hair accessory 1726 to be tensioned over a shorter span between the first and sixth attachment points 1722A and 1722F. This advantageously reduces the footprint of the hair accessory 1726 on the main body 1702, reducing the overall profile the bracelet 1700.

It will be appreciated that in other embodiments the attachment points 1722 can be arranged in ornamental or letter patterns. This beneficially can both reduce the footprint of the hair accessory 1726 on the main body 1702 and provide a fashion feature.

FIG. 24 describes another versatile jewelry embodiment comprising a bracelet 1800. The bracelet 1800 can be similar to other embodiments of the present disclosure including a main body 1802, at least one retaining feature 1804 defined about a periphery of the main body 1802, and first and second opposing end portions 1808, 1810 with a clearance therebetween to form an open cuff design. At least one hair accessory can be adapted to extend over the main body 1802 and secured by the retaining feature 1804.

As seen, the main body 1802 defines one or more attachment features comprising apertures 1830 arranged to allow one or more items to be attached to or carried by the main body 1802 during use. For instance, one or more charms 1832 can be attached to the main body 1802 via ring members 1834 received in the apertures 1830. The charms 1832 can be included for aesthetic purposes or may include medical or other important information.

The apertures 1830 are shown defined in a side surface 1836 of the main body 1802 but can be formed in the outer surface 1818, the inner surface 1816, both sides surfaces 1836, or any other suitable surface on the main body 1802. The apertures 1830 can extend through one or two surfaces of the main body 1802. While two charms 1830 are illustrated, in other embodiments, the bracelet 1800 can include one, three, four, or any other suitable number of charms or other items. Further, while the ring members are described, in other embodiments, the charms 1832 or other items can be attached to the main body via pins or any other suitable attachment means.

FIG. 25 describes yet another versatile jewelry embodiment comprising a bracelet 1900. The bracelet 1900 can be similar to other embodiments of the present disclosure including a main body 1902, at least one retaining feature 1904 defined about a periphery of the main body 1902, and first and second end portions 1908, 1910 with a clearance therebetween to form an open cuff design. It will be appreciated that the clearance can be sized to receive the wrist when the main body 1902 is donned by the user.

At least one hair accessory can be adapted to extend over the main body 1902 and secured by the retaining feature 1904. The at least one retaining feature 1904 can be formed in the outer surface of the main body 1902 or a side surface of the main body 1902.

As seen, the main body 1902 comprises a wire structure 1930 that can advantageously reduce the weight of the bracelet 1900 and/or provide improved ventilation to the user's wrist. In an embodiment, the wire structure 1930 includes an upper wire member 1932 and a lower wire member 1934 attached to one another at the end portions 1908, 1910. Each of the upper and lower wire members 1932, 1934 include side members 1932*a*, 1934*a* defining a gap therebetween.

The wire members 1932, 1934 in combination with a plurality of channel members 1936 define the retaining feature 1904 comprising a channel 1914 for receiving the at least one hair tie accessory.

Similar to other embodiments, the wire structure 1930 can have a rigidity arranged to resist the elasticity of the at least one hair accessory without deformation. For instance, the wire structure 1930 can substantially maintain its shape under the force created by the tension in the hair accessory. Optionally, the wire structure 1930 can have a malleable or resilient configuration, allowing it to be formed or shaped to accommodate an individual's wrist while also having a rigidity arranged to maintain the shape of the wire structure 1930 under the force of the hair accessory.

The channel members 1936 can include a pair of generally upright supports 1942 extending between the upper and lower wire members 1932, 1934 and a cross member 1944 extending between the supports 1942. The channel members 1936 can be spaced along the periphery or circumference of the main body 1902 and arranged to lift the at least one hair accessory off the user's wrist or allow it to only a minimal or desirable amount of pressure. The wire structure 1930 can be made of metal, plastic, rubber, combinations thereof, or any other suitable materials. In the illustrated embodiment, one or more charms 1938 can be attached to one or more of the wire members 1932, 1934 via loop or ring members 1940 as shown.

Optionally, the channel members 1936 can be omitted. For instance, FIG. 27 illustrates a bracelet 2000 having a main body 2002, at least one retaining feature 2004 defined about a periphery of the main body 2002, and first and second end portions 2008, 2010 with a clearance therebetween to form an open cuff design. It will be appreciated that the clearance can be sized to receive the wrist when the main body 2002 is donned by the user. At least one hair accessory can be adapted to extend over the main body 2002 and secured by the retaining feature 2004.

Similar to the previous embodiment, the main body 2002 comprise a wire structure 2030 including an upper wire member 2032 and a lower wire member 2034. Each of the upper and lower wire members 2032, 2034 include side members 2032*a*, 2034*a* defining a transverse gap 2036 and a vertical gap 2038 therebetween. The wire members 2032, 2034 define the retaining feature 2004 comprising a channel 2014 for receiving the at least one hair accessory.

According a variation, the transverse gap 2036 defined between the bottom side members 2034*a* is smaller than the transverse gap 2036 defined between the upper side members 2032*a* such that the bottom of the channel 2014 is narrower than the top of the channel 2014. The bottom of the channel 2014 forms a support surface to at least in part lift or hold the hair accessory off the user's wrist.

The vertical gaps 2038 between the upper and lower wire members 2032, 2034 can be sized to prevent the hair accessory from passing between the wire members 2032, 2034 and jumping out of the channel 2014. This arrangement also provides resistance to movement of the hair accessory out of the channel 2014.

FIG. 27 illustrates yet another versatile jewelry embodiment comprising a bracelet 2100. The bracelet 2100 can similar to other embodiments including a main body 2102 and first and second end portions 2108, 2110 with a clearance therebetween to form an open cuff design. It will be appreciated that the clearance can be sized to receive the wrist when the main body 2102 is donned by the user.

The main body 2102 can be formed by a pair of tubular members 2130 separated by a gap 2132. The tubular members 2130 are attached to one another at the end portions 2108, 2110 via connectors 2150. According to a variation, the gap 2132 can have a width that increases from the end portions 2108, 2110 toward a middle portion 2134 of the main body 2102 generally opposite the clearance. This beneficially can be provide a wider support base for a tray member described below. It also increases user comfort by lowering the profile of the bracelet 2100 on the underside of the wrist.

A tray member 2136 is attached to the top or outer surface of the middle portion 2134. The tray member 2136 includes a bottom 2138 attached to the middle portion 2134 and a rim 2140 extending upwardly from and around the bottom 2138. The tray member 2136 can be arranged to carry jewels, a watch face, lip balm, beauty products identification information, and/or any other suitable item.

The radial outer surface of the rim 2140 defines a retaining feature 2142 comprising a channel 2144 arranged to hold at least one hair accessory 2146. The channel 2142 can include any of the retaining features described herein. This advantageously provides a convenient and comfortable manner to carry the hair accessory 2146 while preventing the hair accessory 2146 from exerting pressure over the wrist.

FIGS. 28A and 28B describe yet another embodiment of a versatile jewelry 2200. The versatile jewelry 2200 can include a ring member 2202 and a necklace 2230 with an aesthetically please look and at least one retaining feature for one or more hair accessories.

The ring member 2202 is configured as a fully circumferential member and defines at least one retaining feature 2204, an inner surface 2216, and an outer surface 2218 opposite the inner surface 2216. At least one hair accessory 2212, such as a hair tie or elastic band, is adapted to extend over the ring member 2202 and arranged to be secured by the retaining feature 2204. The hair accessory 2212 can be removed from the retaining feature 2204 as needed. The hair accessory 2212 spans the periphery of the ring member 2202 and the ring member 2202 has a rigid or semi-rigid configuration arranged to resist the elasticity of the hair accessory 2212.

The retaining feature 2204 comprises a groove or channel 2214 defined in the outer surface 2218. The groove 2214 is shown defined in the outer surface 2218 but can be formed in one or more side surfaces of the ring member 2202. Moreover, the groove 2214 can have any suitable cross-sectional shape. The groove 2214 can have a constant or variable depth and the ring member 2202 can include any of the features describe herein.

The necklace 2230 can comprise a jewelry chain adapted to be worn around a user's neck. As seen, the ring member 2202 can be attached or secured to the necklace 2230 such that the ring member 2202 can be worn as a pendant when desired.

In an embodiment, the ring member 2202 can be removably attached to end portions of the necklace 2230 via retaining members 2232 connected to the necklace 2230. This beneficially provides an aesthetically pleasing and comfortable manner to carry the hair accessory 2212 when it is not in use. According to a variation, the ring member 2202 can be detached and/or removed from the necklace 2230 as desired and the retaining members 2232 can be connected together, providing an attractive piece of jewelry.

Not necessarily all such objects or advantages may be achieved under any embodiment of the invention. Those skilled in the art will recognize that the invention may be embodied or carried out to achieve or optimize one advantage or group of advantages as taught without achieving other objects or advantages as taught or suggested.

The skilled artisan will recognize the interchangeability of various components from different embodiments described. Besides the variations described herein, other known equivalents for each feature can be mixed and matched by one of ordinary skill in this art to construct a versatile jewelry under principles of the present invention. For instance, the retaining feature can comprise a width of the bracelet so the elastic band does not fall off the bracelet, helping to ensure proper distribution from the elastic band. In other embodiments, the versatile jewelry can comprise a two rings, one on each finger where the hair accessory or band crosses over two fingers. In other embodiments, the retaining feature can comprise a circuferential groove or channel formed in a side surface of the main body of the versatile jewelry. It will also be appreciated that that the elastic band can have any suitable cross-sectional shape.

Although this invention has been disclosed in certain preferred embodiments and examples, it will be understood by those skilled in the art that the present invention extends beyond the disclosed embodiments to other alternative embodiments and/or uses of the invention and obvious modifications and equivalents thereof. It is intended that the present invention disclosed should not be limited by the disclosed embodiments described above, but should be determined only by a fair reading of the claims that follow.

The invention claimed is:

1. A versatile jewelry comprising:

a semi-rigid or rigid main body arranged to extend over a wrist of a user, the main body defining an inner surface arranged to be worn against the wrist, an outer surface opposite the inner surface, first and second end portions defining a clearance therebetween sized to receive the wrist when the main body is donned by the user, and a circumferential groove formed in the main body; and a hair band adapted to be selectively disposed within the groove and to span the clearance at a height above the inner surface, and the main body being arranged to substantially hold the hair band in place when the hair band is disposed in the groove, the hair band having an elasticity, and the main body having a rigidity arranged to resist the elasticity of the hair band without deformation of the main body and to distribute pressure from the hair band away from the wrist.

2. The versatile jewelry of claim 1, wherein the main body suspends the hair band at a height above the inner surface of the main body across the clearance.

3. The versatile jewelry of claim 1, wherein the main body is formed of a metal material.

4. The versatile jewelry of claim 1, wherein the main body is formed of a plastic material.

5. The versatile jewelry of claim 1, wherein the groove has a varying depth along a length of the groove.

6. The versatile jewelry of claim 1, wherein the groove has a rectangular cross sectional shape.

7. The versatile jewelry of claim 1, wherein the groove defines sidewalls having a planar configuration.

8. The versatile jewelry of claim 7, wherein the sidewalls are parallel to one another.

9. The versatile jewelry of claim 1, wherein the groove extends through the first and second end portions.

10. The versatile jewelry of claim 1, wherein the main body includes first and second protruding portions extending over the groove and a gap defined between the first and second protruding portions.

11. The versatile jewelry of claim 10, wherein the gap is configured and dimensioned to allow the hair band to pass therethrough.

12. The versatile jewelry of claim 1, wherein the main body defines a semi-elliptical profile.

13. The versatile jewelry of claim 1, wherein the main body defines a semi-circular profile.

14. The versatile jewelry of claim 1, wherein the outer surface is parallel to the inner surface.

15. The versatile jewelry of claim 1, wherein the first and second end portions define a planar surface.

16. A versatile jewelry comprising:

a semi-rigid or rigid main body formed of a metal material and arranged to extend over a wrist of a user, the main body defining an inner surface arranged to be worn against the wrist, an outer surface opposite the inner surface, first and second end portions defining a clearance therebetween sized to receive the wrist when the main body is donned by the user, and a circumferential groove formed in the main body having a pair of sidewalls and extending through the first and second end portions; and at least one hair band adapted to be selectively disposed within the groove and to span the clearance at a height above the inner surface, and the main body being arranged to substantially hold the at least one hair band in place when the at least one hair band is disposed in the groove, the at least one hair band having an elasticity, and the main body having a rigidity arranged to resist the elasticity of the at least one hair band and to distribute pressure from the at least one hair band away from the wrist.

17. The versatile jewelry of claim 16, wherein the main body suspends the at least one hair band at a height above the inner surface of the main body across the clearance.

18. The versatile jewelry of claim 16, wherein the rigidity of the main body is arranged to maintain a shape of the main body under the force of the at least one hair band in the groove.

19. The versatile jewelry of claim 16, wherein the groove defines sidewalls having a planar configuration.

20. A versatile jewelry comprising:

a semi-rigid or rigid main body arranged to extend over a wrist of a user, the main body defining an inner surface arranged to be worn against the wrist, an outer surface opposite the inner surface, first and second end portions defining a clearance therebetween sized to receive the wrist when the main body is donned by the user, and a circumferential groove formed in the main body; and a hair band adapted to be selectively disposed within the groove and to span the clearance at a height above the inner surface, and the main body being arranged to substantially hold the hair band in place when the hair band is disposed in the groove, the hair band having an elasticity, and the main body having a rigidity arranged to resist the elasticity of the hair band and to distribute pressure from the hair band away from the wrist.

* * * * *